US011143176B2

(12) United States Patent
Jeon et al.

(10) Patent No.: US 11,143,176 B2
(45) Date of Patent: Oct. 12, 2021

(54) LINEAR COMPRESSOR

(71) Applicant: LG Electronics Inc., Seoul (KR)

(72) Inventors: Wooju Jeon, Seoul (KR); Donghan Kim, Seoul (KR); Kichul Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 23 days.

(21) Appl. No.: 16/692,913

(22) Filed: Nov. 22, 2019

(65) Prior Publication Data

US 2020/0088181 A1 Mar. 19, 2020

Related U.S. Application Data

(62) Division of application No. 16/502,868, filed on Jul. 3, 2019, now Pat. No. 11,002,265.

(30) Foreign Application Priority Data

Jul. 3, 2018 (KR) ..... 10-2018-0077204

(51) Int. Cl.
*F04B 39/02* (2006.01)
*F04B 39/12* (2006.01)

(52) U.S. Cl.
CPC ..... *F04B 39/0276* (2013.01); *F04B 39/0292* (2013.01); *F04B 39/123* (2013.01)

(58) Field of Classification Search
CPC . F04B 39/0276; F04B 39/0292; F04B 39/123
See application file for complete search history.

(56) References Cited

U.S. PATENT DOCUMENTS

| | | | | |
|---|---|---|---|---|
| 1,048,810 | A | 12/1912 | Davis | |
| 4,644,851 | A | 2/1987 | Young | |
| 9,890,779 | B2 * | 2/2018 | Ahn | F04B 53/20 |
| 9,989,052 | B2 | 6/2018 | Park et al. | |
| 2008/0008610 | A1 | 1/2008 | Muth et al. | |
| 2010/0046866 | A1 | 2/2010 | Schubert | |
| 2010/0247308 | A1 * | 9/2010 | Giacchi | B23K 26/0626 415/229 |

FOREIGN PATENT DOCUMENTS

| | | |
|---|---|---|
| CN | 1157027 | 8/1997 |
| CN | 1170859 | 1/1998 |

(Continued)

OTHER PUBLICATIONS

Extended European Search Report in European Application No. 19181368.2, dated Sep. 25, 2019, 6 pages.

(Continued)

*Primary Examiner* — Patrick Hamo
(74) *Attorney, Agent, or Firm* — Fish & Richardson P.C.

(57) ABSTRACT

Provided is a linear compressor. The linear compressor includes a piston, a cylinder, and a bearing inflow passage. The bearing inflow passage includes a first bearing inflow passage extending inward from an outer circumferential surface of the cylinder in the radial direction and a second bearing inflow passage extending from the first bearing inflow passage to an inner circumferential surface of the cylinder. The second bearing inflow passage extends from the inner circumferential surface of the cylinder in a circumferential direction.

20 Claims, 14 Drawing Sheets

(56) References Cited

FOREIGN PATENT DOCUMENTS

| | | |
|---|---|---|
| CN | 1461385 | 12/2003 |
| CN | 101868318 | 10/2010 |
| CN | 105275775 | 1/2016 |
| CN | 107339207 | 11/2017 |
| CN | 107339216 | 11/2017 |
| EP | 2781747 | 9/2014 |
| KR | 20150031723 | 3/2015 |
| KR | 1020160000403 | 1/2016 |
| KR | 1020170124903 | 11/2017 |

OTHER PUBLICATIONS

CN Office Action in Chinese Appln. No. 201910412794.5, dated Oct. 22, 2020, 16 pages (with English translation).
United States Notice of Allowance and Fees Due in U.S. Appl. No. 16/502,868, dated Jan. 13, 2021, 6 pages.
CN Office Action in Chinese Appln. No. 2019104127945, dated Jun. 25, 2021, 7 pages (with English translation).

* cited by examiner

LINEAR COMPRESSOR

CROSS-REFERENCE TO RELATED APPLICATIONS

This application is a divisional of U.S. application Ser. No. 16/502,868, filed on Jul. 3, 2019, which claims priority under 35 U.S.C. 119 and 35 U.S.C. 365 to Korean Patent Application No. 10-2018-0077204 filed on Jul. 3, 2018. The disclosures of the prior applications are incorporated by reference in their entirety.

BACKGROUND

The present disclosure relates to a linear compressor.

In general, compressors are machines that receive power from a power generation device such as an electric motor or a turbine to compress air, a refrigerant, or various working gases, thereby increasing a pressure. Compressors are being widely used in home appliances or industrial fields.

Compressors are largely classified into reciprocating compressors, rotary compressors, and scroll compressors.

In such a reciprocating compressor, a compression space, in which a working gas is suctioned or discharged, is provided between a portion and a cylinder so that a refrigerant is compressed while the piston linearly reciprocates within the cylinder.

In addition, in such a rotary compressor, a compression space, in which a working gas is suctioned or discharged, is provided between a roller that rotates eccentrically and a cylinder so that a refrigerant is compressed while the roller rotates eccentrically along an inner wall of the cylinder.

In addition, in such a scroll compressor, a compression space, in which a working gas is suctioned and discharged, is provided between an orbiting scroll and a fixed scroll so that a refrigerant is compressed while the orbiting scroll rotates along the fixed scroll.

In recent years, a linear compressor, in which a piston is directly connected to a driving motor that linearly reciprocates, among the reciprocating compressors has been developed. The linear compressor has a simple structure that is capable of improving compression efficiency without mechanical loss due to motion switching.

In the linear compressor, the piston linearly reciprocates within the cylinder by the driving motor (a linear motor) in a sealed shell. Since the piston linearly reciprocates, the refrigerant is suctioned and compressed and then is discharged.

Also, the linear compressor may supply a refrigerant gas to the piston that linearly reciprocates to perform a bearing function. That is, the linear compressor may be driven through a gas bearing structure using the refrigerant without using a separate bearing fluid such as oil.

In relation to the linear compressor having such a gas bearing structure, the present applicant has field a prior art document 1.

PRIOR ART DOCUMENT 1

1. Korean Patent Publication Number: 10-2016-0000324 (Date of Publication: Jan. 4, 2016)

2. Tile of the Invention: LINEAR COMPRESSOR

A gas bearing structure in which a refrigerant gas is supplied into a space between a cylinder and a piston to perform a bearing function is disclosed in the linear compressor of the prior art document 1. The refrigerant gas flows to an outer circumferential surface of the piston through the cylinder to act as a bearing with respect to the piston.

In detail, a gas inflow part that is recessed inward is provided in an outer circumferential surface of the cylinder to receive a gas refrigerant. Also, an orifice is provided from the gas inflow part to the inner circumferential surface of the cylinder, and the gas refrigerant accommodated in the gas inflow part flows to the outer circumferential surface of the piston through the orifice.

Here, the linear compressor disclosed in the prior art document 1 has the following limitations.

(1) The gas refrigerant flowing to the outer circumferential surface of the piston does not effectively support the piston. Particularly, in the structure disclosed in the prior art document 1, to effectively support the piston, a relatively large amount of gas refrigerant has to be supplied.

(2) In addition, when a relatively large amount of gas refrigerant is supplied to the gas bearing to effectively support the piston, a flow rate of the refrigerant in the whole system may be reduced to deteriorate compression efficiency.

(3) In addition, the orifice may be closed by foreign substances contained in the gas refrigerant accommodated in the gas inflow part. Therefore, the gas refrigerant may not flow through the orifice, and thus, a driving part such as the piston may be damaged.

SUMMARY

Embodiments provide a linear compressor in which a piston is effectively supported through a relatively small amount of gas refrigerant.

Embodiments also provide a linear compressor in which a relatively small amount of gas refrigerant is used as a gas bearing to increase in flow rate of the refrigerant in the whole system and improve compression efficiency.

In one embodiment, a linear compressor includes: a piston reciprocating in an axial direction, a cylinder disposed outside the piston in a radial direction to accommodate the piston; and a bearing inflow passage provided to pass through the cylinder so as to supply a bearing refrigerant to the piston.

The bearing inflow passage includes: a first bearing inflow passage extending inward from an outer circumferential surface of the cylinder in the radial direction; and a second bearing inflow passage extending from the first bearing inflow passage to an inner circumferential surface of the cylinder. The second bearing inflow passage extends from the inner circumferential surface of the cylinder in a circumferential direction.

The first bearing inflow passage may be a passage extending in the radial direction, and the second bearing inflow passage may be a passage extending in the circumferential direction. The first bearing inflow passage may have a cross-sectional area less than that of the second bearing inflow passage.

The first bearing inflow passage may be provided as an orifice that restricts a flow of the bearing refrigerant. The first bearing inflow passage may have a very narrow cross-sectional area.

The second bearing inflow passage may be provided as a pocket accommodating the bearing refrigerant supplied through the first bearing inflow passage. The piston may be supported by a pressure of the refrigerant accommodated in the second bearing inflow passage.

The details of one or more embodiments are set forth in the accompanying drawings and the description below.

Other features will be apparent from the description and drawings, and from the claims.

DETAILED DESCRIPTION OF THE EMBODIMENTS

Figure 1:
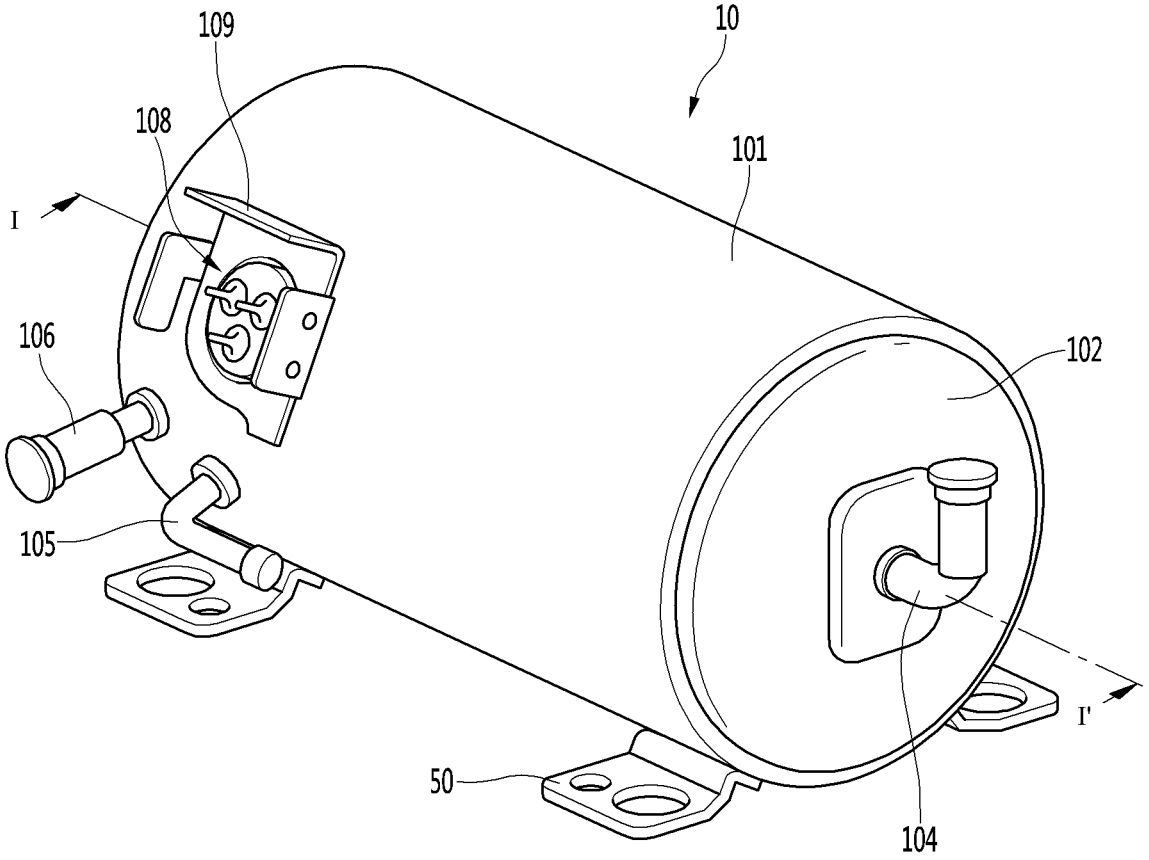
FIG. 1 is a view of a linear compressor according to an embodiment.

Hereinafter, embodiments of the present invention will be described in detail with reference to the accompanying drawings. It is noted that the same or similar components in the drawings are designated by the same reference numerals as far as possible even if they are shown in different drawings. In the following description of the present disclosure, a detailed description of known functions and configurations incorporated herein will be omitted to avoid making the subject matter of the present disclosure unclear.

In the description of the elements of the present disclosure, the terms 'first', 'second', 'A', 'B', '(a)', and '(b)' may be used. However, since the terms are used only to distinguish an element from another, the essence, sequence, and order of the elements are not limited by them. When it is described that an element is "coupled to", "engaged with", or "connected to" another element, it should be understood that the element may be directly coupled or connected to the other element but still another element may be "coupled to", "engaged with", or "connected to" the other element between them.

Figure 2:
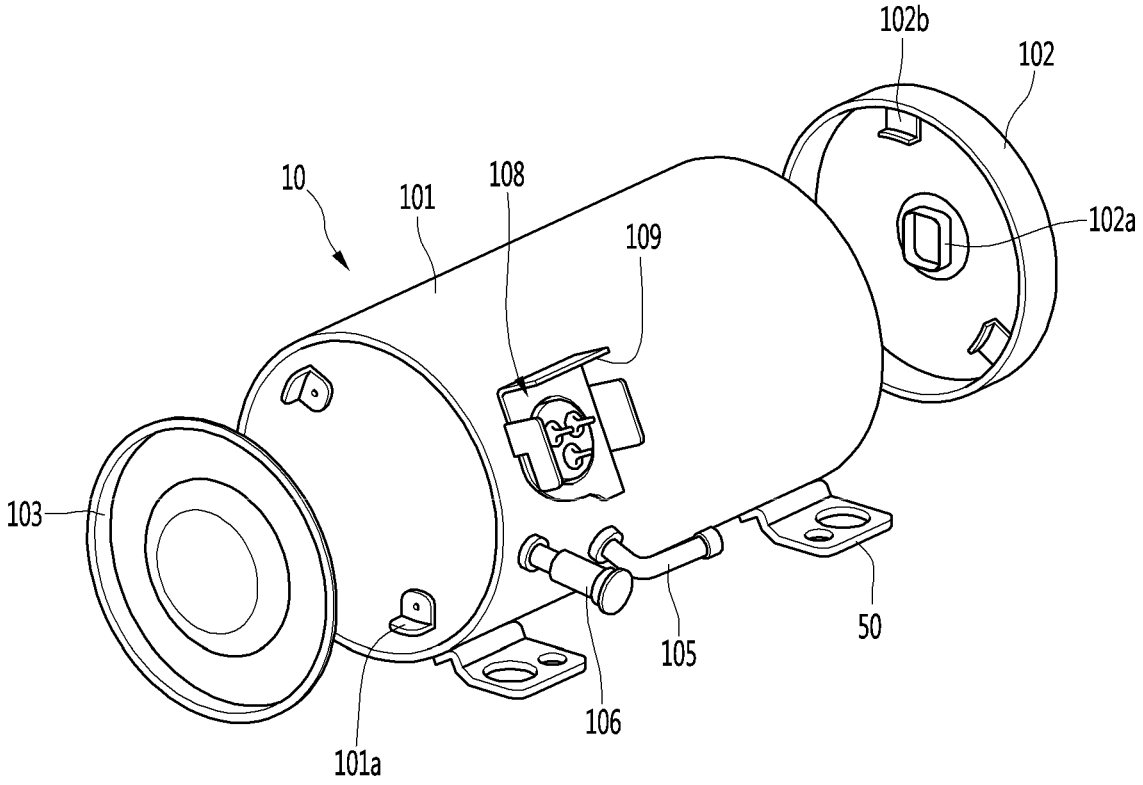
FIG. 2 is an exploded view illustrating a shell and a shell cover of the linear compressor according to an embodiment.

FIG. 1 is a view of a linear compressor according to an embodiment, and FIG. 2 is an exploded view illustrating a shell and a shell cover of the linear compressor according to an embodiment.

Referring to FIGS. 1 and 2, a linear compressor 10 according to an embodiment includes a shell 101 and shell covers 102 and 103 coupled to the shell 101. In a broad sense, each of the shell covers 102 and 103 may be understood as one component of the shell 101.

A leg 50 may be coupled to a lower portion of the shell 101. The leg 50 may be coupled to a base of a product in which the linear compressor 10 is installed. For example, the product may include a refrigerator, and the base may include a machine room base of the refrigerator. For another example, the product may include an outdoor unit of an air conditioner, and the base may include a base of the outdoor unit The shell 101 may have an approximately cylindrical shape and be disposed to lie in a horizontal direction or an axial direction. In FIG. 1, the shell 101 may extend in the horizontal direction and have a relatively low height in a radial direction. That is, since the linear compressor 10 has a low height, when the linear compressor 10 is installed in the machine room base of the refrigerator, a machine room may be reduced in height.

A terminal 108 may be installed on an outer surface of the shell 101. The terminal 108 may be understood as a component for transferring external power to a motor assembly (see reference numeral 140 of FIG. 3) of the linear compressor 10. The terminal 108 may be connected to a lead line of a coil (see reference numeral 141*c* of FIG. 3).

A bracket 109 is installed outside the terminal 108. The bracket 109 may include a plurality of brackets surrounding the terminal 108. The bracket 109 may protect the terminal 108 against an external impact and the like.

Both sides of the shell 101 may be opened. The shell covers 102 and 103 may be coupled to both opened sides of the shell 101. In detail, the shell covers 102 and 103 include a first shell cover 102 coupled to one opened side of the shell 101 and a second shell cover 103 coupled to the other opened side of the shell 101. An inner space of the shell 101 may be sealed by the shell covers 102 and 103.

In FIG. 1, the first shell cover 102 may be disposed at a right portion of the linear compressor 10, and the second shell cover 103 may be disposed at a left portion of the linear compressor 10. That is, the first and second shell covers 102 and 103 may be disposed to face each other.

The linear compressor 10 further includes a plurality of pipes 104, 105, and 106, which are provided in the shell 101 or the shell covers 102 and 103 to suction, discharge, or inject the refrigerant. The plurality of pipes 104, 105, and 106 include a suction pipe 104, a discharge pipe 105, and a process pipe 106.

The suction pipe 104 is provided so that the refrigerant is suctioned into the linear compressor 10. For example, the suction pipe 104 may be coupled to the first shell cover 102. The refrigerant may be suctioned into the linear compressor 10 through the suction pipe 104 in an axial direction.

The discharge pipe 105 is provided so that the compressed refrigerant is discharged from the linear compressor 10. The discharge pipe 105 may be coupled to an outer circumferential surface of the shell 101. The refrigerant suctioned through the suction pipe 104 may flow in the axial direction and then be compressed. Also, the compressed refrigerant may be discharged through the discharge pipe 105. The discharge pipe 105 may be disposed at a position that is closer to the second shell cover 103 than the first shell cover 102.

The process pipe 106 may be provided to supplement the refrigerant into the linear compressor 10. The process pipe 106 may be coupled to an outer circumferential surface of the shell 101. A worker may inject the refrigerant into the linear compressor 10 through the process pipe 106.

Here, the process pipe 106 may be coupled to the shell 101 at a height different from that of the discharge pipe 105 to avoid interference with the discharge pipe 105. The height is understood as a distance from the leg 50 in the vertical direction (or the radial direction). Since the discharge pipe 105 and the process pipe 106 are coupled to the outer circumferential surface of the shell 101 at the heights different from each other, worker's work convenience may be improved.

At least a portion of the second shell cover 103 may be disposed adjacent to the inner circumferential surface of the shell 101, which corresponds to a point to which the process pipe 106 is coupled. That is, at least a portion of the second shell cover 103 may act as flow resistance of the refrigerant injected through the process pipe 106.

Thus, in view of the passage of the refrigerant, the passage of the refrigerant introduced through the process pipe 106 may have a size that gradually decreases toward the inner space of the shell 101. In this process, the refrigerant may decrease in pressure to evaporate the refrigerant.

Also, in this process, an oil component contained in the refrigerant may be separated. Thus, the gas refrigerant from which the oil component is separated may be introduced into the piston 130 to improve compression performance of the refrigerant. Here, the oil component may be understood as working oil existing in a cooling system.

A cover support part 102*a* is disposed on an inner surface of the first shell cover 102. A second support device 185 that will be described later may be coupled to the cover support part 102*a*. The cover support part 102*a* and the second support device 185 may be understood as devices for supporting a main body of the linear compressor 10. Here, the main body of the compressor represents a component provided in the shell 101. For example, the main body may include a driving part that reciprocates forward and backward and a support part supporting the driving part.

The driving part may include components such as the piston 130, a magnet frame 138, a permanent magnet 146, a support 137, and a suction muffler 150, which will be described later. Also, the support part may include components such as resonant springs 176*a* and 176*b*, a rear cover 170, a stator cover 149, a first support device 165, and a second support device 185, which will be described later.

A stopper 102*b* may be disposed on the inner surface of the first shell cover 102. The stopper 102*b* may be understood as a component for preventing the main body of the compressor, particularly, the motor assembly 140 from being bumped by the shell 101 and thus damaged due to the vibration or the impact occurring during the transportation of the linear compressor 10.

Particularly, the stopper 102*b* may be disposed adjacent to the rear cover 170 that will be described later. Thus, when the linear compressor 10 is shaken, the rear cover 170 may interfere with the stopper 102*b* to prevent the impact from being transmitted to the motor assembly 140.

A spring coupling part 101*a* may be disposed on the inner circumferential surface of the shell 101. For example, the spring coupling part 101*a* may be disposed at a position that is adjacent to the second shell cover 103. The spring coupling part 101*a* may be coupled to a first support spring 166 of the first support device 165 that will be described later. Since the spring coupling part 101*a* and the first support device 165 are coupled to each other, the main body of the compressor may be stably supported inside the shell 101.

Figure 3:
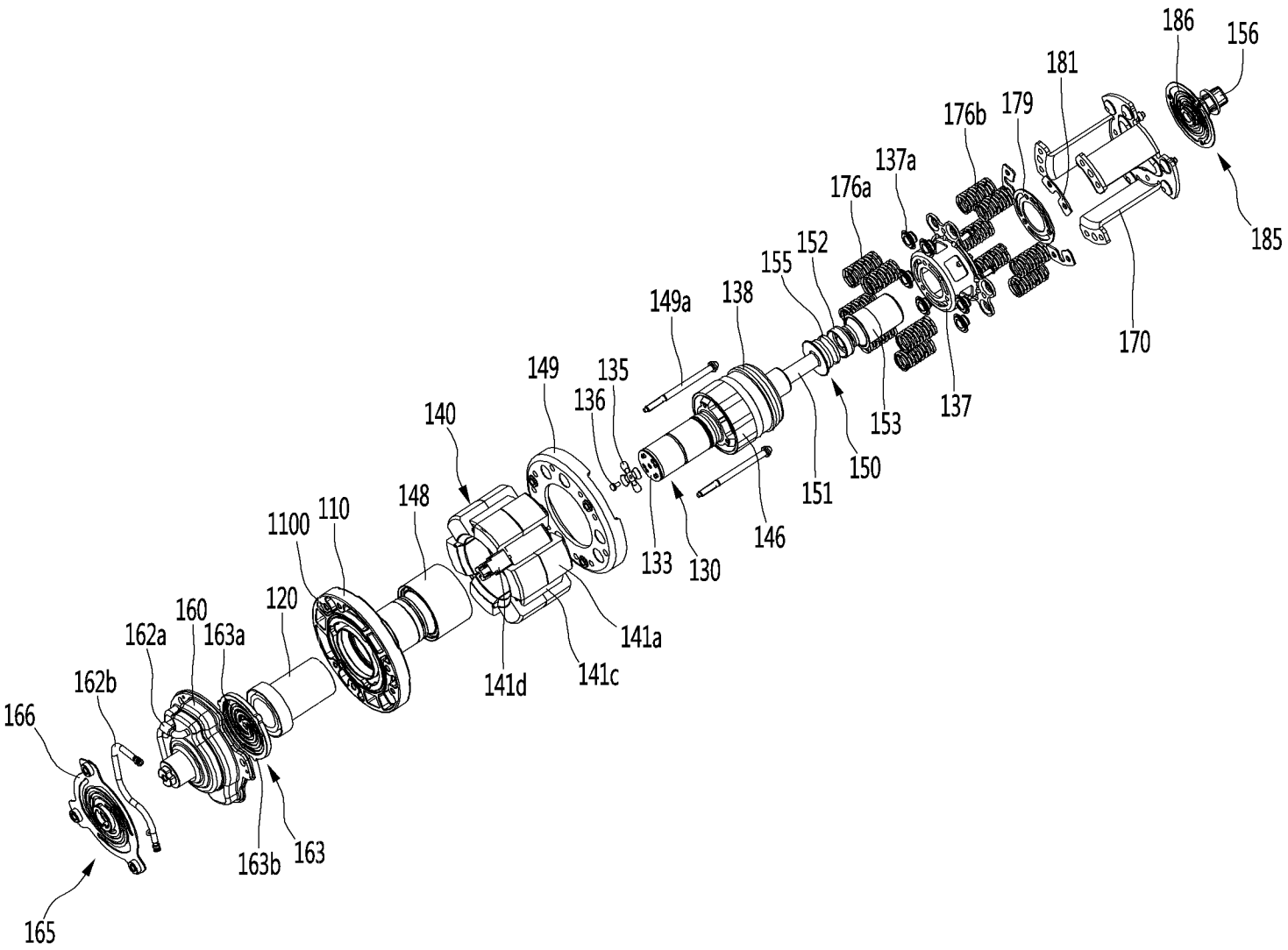
FIG. 3 is an exploded view illustrating an internal configuration of the linear compressor according to an embodiment.
Figure 4:
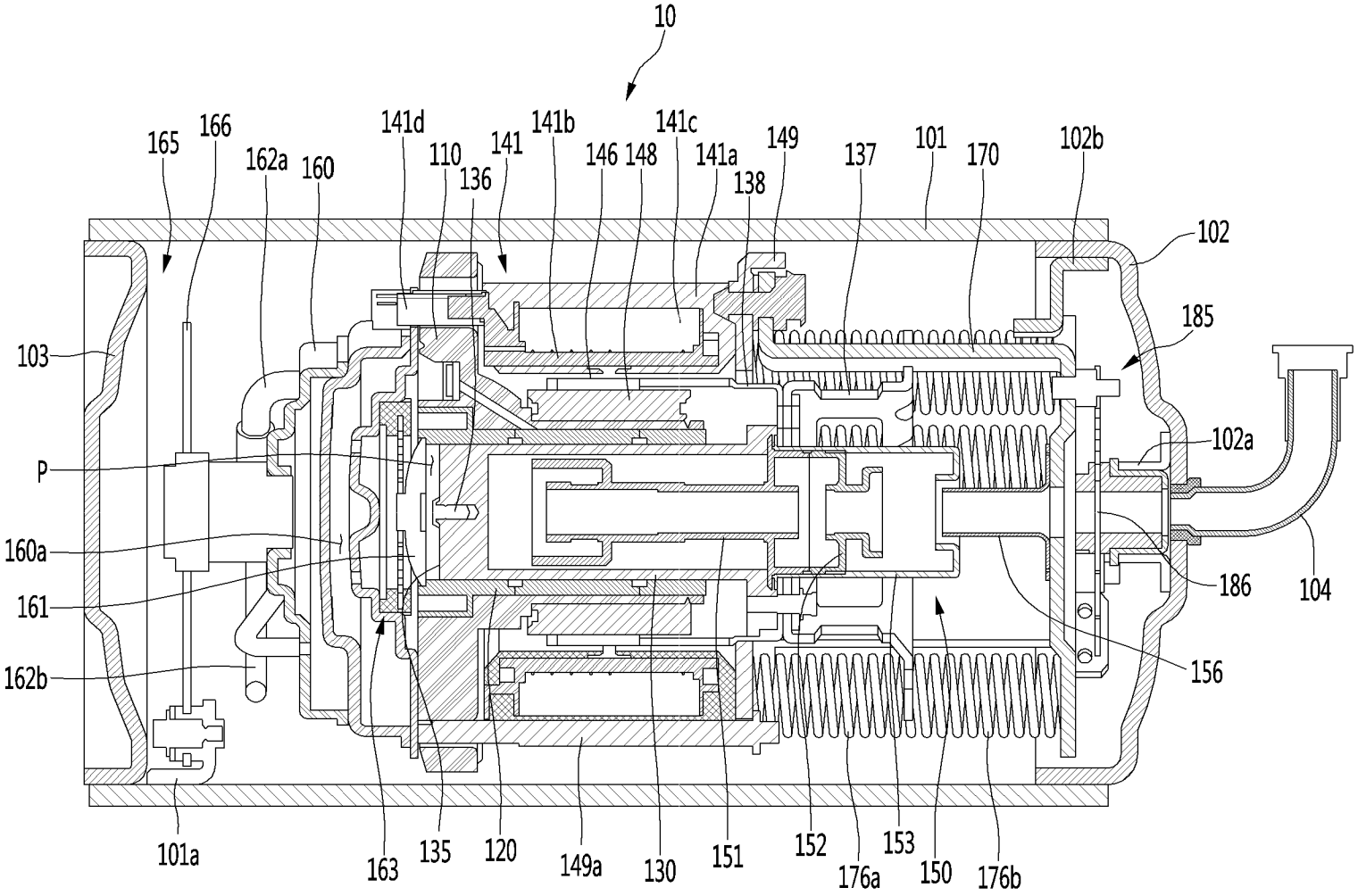
FIG. 4 is a cross-sectional view taken along line A-A' of FIG. 1.

FIG. 3 is an exploded view illustrating an internal configuration of the linear compressor according to an embodiment, and FIG. 4 is a cross-sectional view taken along line A-A' of FIG. 1. For convenience, the shell 101 and the shell covers 102 and 103 will be omitted in FIG. 3.

Referring to FIGS. 3 and 4, the linear compressor 10 according to the ideas of the present disclosure may include a frame 110, a cylinder 120, a piston 130, and a motor assembly 140. The motor assembly 140 may correspond to a linear motor that applies driving force to the piston 130, and the piston may reciprocate by the driving of the motor assembly 140.

Hereinafter, the direction will be defined.

The "axial direction" may be understood as a direction in which the piston 130 reciprocates, i.e., the horizontal direction in FIG. 4. Also, in the axial direction", a direction from the suction pipe 104 toward a compression space P, i.e., a direction in which the refrigerant flows may be defined as a "front direction", and a direction opposite to the front direction may be defined as a "rear direction". When the piston 130 moves forward, the compression space P may be compressed.

On the other hand, the "radial direction" may be understood as a direction that is perpendicular to the direction in which the piston 130 reciprocates, i.e., the vertical direction in FIG. 4. Also, in the "radial direction", a direction from a central axis of the piston 130 toward the shell 101 may be defined as "the outside" in the radial direction, and the opposite direction may be defined as "the inside" in the radial direction.

The cylinder 120 is accommodated in the frame 110. Here, the frame 110 is understood as a component for fixing the cylinder 120. For example, the cylinder 120 may be press-fitted into the frame 110.

Also, the piston 130 is movably accommodated in the cylinder 120. Also, the linear compressor 10 further includes a suction muffler 150 accommodated in the piston 130.

The suction muffler 150 may correspond to a component for reducing noise generated from the refrigerant suctioned through the suction pipe 104. In detail, the refrigerant suctioned through the suction pipe 104 flows into the piston 130 via the suction muffler 150. While the refrigerant passes through the suction muffler 150, the flow noise of the refrigerant may be reduced.

The suction muffler 150 includes a plurality of mufflers 151, 152, and 153. The plurality of mufflers 151, 152, and 153 include a first muffler 151, a second muffler 152, and a third muffler 153, which are coupled to each other. The refrigerant suctioned through the suction pipe 104 may successively pass through the third muffler 153, the second muffler 152, and the first muffler 151.

In detail, the first muffler 151 is disposed within the piston 130, and the second muffler 152 is coupled to a rear side of the first muffler 151. Also, the third muffler 153 accommodates the second muffler 152 therein and extends to a rear side of the first muffler 151.

Also, the suction muffler 150 further includes a muffler filter 155. The muffler filter 155 may be disposed on an interface on which the first muffler 151 and the second muffler 152 are coupled to each other. For example, the muffler filter 155 may have a circular shape, and an outer circumferential portion of the muffler filter 155 may be supported between the first and second mufflers 151 and 152.

The cylinder 120 has a compression space P in which the refrigerant is compressed by the piston 130. Also, a suction hole 133 through which the refrigerant is introduced into the compression space P is defined in a front surface of the piston 130, and a suction valve 135 for selectively opening the suction hole 133 is disposed on a front side of the suction hole 133. The suction valve 135 may be coupled to the piston 130 by a coupling member 136.

A discharge cover 160 defining a discharge space 160*a* for the refrigerant discharged from the compression space P and a discharge valve assembly 161 and 163 coupled to the discharge cover 160 to selectively discharge the refrigerant compressed in the compression space P are provided at a front side of the compression space P. The discharge space 160*a* includes a plurality of space parts that are partitioned by inner walls of the discharge cover 160. The plurality of space parts are disposed in the front and rear direction to communicate with each other.

The discharge valve assembly 161 and 163 includes a discharge valve 161 that is opened when the pressure of the compression space P is above a discharge pressure to introduce the refrigerant into the discharge space and a spring assembly 163 disposed between the discharge valve 161 and the discharge cover 160 to provide elastic force in the axial direction.

The spring assembly 163 includes a valve spring 163*a* and a spring support part 163*b* for supporting the valve spring 163*a* to the discharge cover 160. For example, the valve spring 163*a* may include a plate spring. Also, the spring support part 163*b* may be integrally injection-molded to the valve spring 163*a* through an injection-molding process.

The discharge valve 161 is coupled to the valve spring 163*a*, and a rear portion or a rear surface of the discharge valve 161 is disposed to be supported on the front surface of the cylinder 120. When the discharge valve 161 is supported on the front surface of the cylinder 120, the compression space may be maintained in the sealed state. When the discharge valve 161 is spaced apart from the front surface of the cylinder 120, the compression space P may be opened to allow the refrigerant in the compression space P to be discharged.

Thus, the compression space P may be understood as a space defined between the suction valve 135 and the discharge valve 161. Also, the suction valve 135 may be disposed on one side of the compression space P, and the discharge valve 161 may be disposed on the other side of the compression space P, i.e., an opposite side of the suction valve 135.

While the piston 130 linearly reciprocates within the cylinder 120, when the pressure of the compression space P is below the discharge pressure and a suction pressure, the suction valve 135 may be opened to suction the refrigerant into the compression space P. On the other hand, when the pressure of the compression space P is above the suction pressure, the suction valve 135 may compress the refrigerant of the compression space P in a state in which the suction valve 135 is closed.

When the pressure of the compression space P is above the discharge pressure, the valve spring 163*a* may be deformed forward to open the discharge valve 161. Here, the refrigerant may be discharged from the compression space P into the discharge space of the discharge cover 160. When the discharge of the refrigerant is completed, the valve spring 163*a* may provide restoring force to the discharge valve 161 to close the discharge valve 161.

The linear compressor 10 further includes a cover pipe 162*a* coupled to the discharge cover 160 to discharge the refrigerant flowing through the discharge space 160*a* of the discharge cover 160. For example, the cover pipe 162*a* may be made of a metal material.

Also, the linear compressor 10 further includes a loop pipe 162*b* coupled to the cover pipe 162*a* to transfer the refrigerant flowing through the cover pipe 162*a* to the discharge pipe 105. The loop pipe 162*b* may have one side of the loop pipe 162*b* coupled to the cover pipe 162*a* and the other side coupled to the discharge pipe 105.

The loop pipe 162*b* may be made of a flexible material and have a relatively long length. Also, the loop pipe 162*b* may roundly extend from the cover pipe 162*a* along the inner circumferential surface of the shell 101 and be coupled to the discharge pipe 105. For example, the loop pipe 162*b* may have a wound shape.

The motor assembly 140 includes an outer stator 141 fixed to the frame 110 and disposed to surround the cylinder 120, an inner stator 148 disposed to be spaced inward from the outer stator 141, and a permanent magnet 146 disposed in a space between the outer stator 141 and the inner stator 148.

The permanent magnet 146 may linearly reciprocate by a mutual electromagnetic force between the outer stator 141 and the inner stator 148. Also, the permanent magnet 146 may be provided as a single magnet having one polarity or be provided by coupling a plurality of magnets having three polarities to each other.

The permanent magnet 146 may be disposed on the magnet frame 138. The magnet frame 138 may have an approximately cylindrical shape and be disposed to be inserted into the space between the outer stator 141 and the inner stator 148.

In detail, referring to the cross-sectional view of FIG. 4, the magnet frame 138 may be bent forward after extending from the outside in the radial direction from the rear side of the piston 130. The permanent magnet 146 may be installed on a front portion of the magnet frame 138. When the permanent magnet 146 reciprocates, the piston 130 may reciprocate together with the permanent magnet 146 in the axial direction.

The outer stator 141 includes coil winding bodies 141*b*, 141*c*, and 141*d* and a stator core 141*a*. The coil winding bodies 141*b*, 141*c*, and 141*d* include a bobbin 141*b* and a coil 141*c* wound in a circumferential direction of the bobbin 141*b*. The coil winding bodies 141*b*, 141*c*, and 141*d* further include a terminal part 141*d* that guides a power line connected to the coil 141*c* so that the power line is led out or exposed to the outside of the outer stator 141.

The stator core 141*a* includes a plurality of core blocks in which a plurality of laminations are laminated in a circumferential direction. The plurality of core blocks may be disposed to surround at least a portion of the coil winding bodies 141*b* and 141*c*.

A stator cover 149 may be disposed on one side of the outer stator 141. That is, the outer stator 141 may have one side supported by the frame 110 and the other side supported by the stator cover 149.

The linear compressor 10 further includes a cover coupling member 149*a* for coupling the stator cover 149 to the frame 110. The cover coupling member 149*a* may pass through the stator cover 149 to extend forward to the frame 110 and then be coupled to the frame 110.

The inner stator 148 is fixed to an outer circumference of the frame 110. Also, in the inner stator 148, the plurality of laminations are laminated outside the frame 110 in the circumferential direction.

The linear compressor 10 further includes a support 137 for supporting the piston 130. The support 137 may be coupled to a rear portion of the piston 130, and the muffler 150 may be disposed to pass through the inside of the support 137. Here, the piston 130, the magnet frame 138, and the support 137 may be coupled to each other by using a coupling member.

A balance weight 179 may be coupled to the support 137. A weight of the balance weight 179 may be determined based on a driving frequency range of the compressor body.

The linear compressor 10 further include a rear cover 170 coupled to the stator cover 149 to extend backward. In detail, the rear cover 170 includes three support legs, and the three support legs may be coupled to a rear surface of the stator cover 149.

A spacer 181 may be disposed between the three support legs and the rear surface of the stator cover 149. A distance from the stator cover 149 to a rear end of the rear cover 170 may be determined by adjusting a thickness of the spacer 181.

Also, the rear cover 170 may be spring-supported by the support 137. Also, the rear side of the rear cover 170 may be supported by the second support device 185 that will be described later.

The linear compressor 10 further includes an inflow guide part 156 coupled to the rear cover 170 to guide an inflow of the refrigerant into the muffler 150. At least a portion of the inflow guide part 156 may be inserted into the suction muffler 150.

The linear compressor 10 further includes a plurality of resonant springs 176*a* and 176*b* that are adjusted in natural frequency to allow the piston 130 to perform a resonant motion. The plurality of resonant springs 176*a* and 176*b* include a first resonant spring 176*a* supported between the support 137 and the stator cover 149 and a second resonant spring 176*b* supported between the support 137 and the rear cover 170.

The driving part that reciprocates within the linear compressor 10 may stably move by the action of the plurality of resonant springs 176*a* and 176*b* to reduce the vibration or noise due to the movement of the driving part. Also, the support 137 may include a first spring support part 137*a* coupled to the first resonant spring 176*a*.

The linear compressor 10 further includes a first support device 165 coupled to the discharge cover 160 to support one side of the main body of the compressor 10. The first support device 165 may be disposed adjacent to the second shell cover 103 to elastically support the main body of the compressor 10. In detail, the first support device 165 includes a first support spring 166. The first support spring 166 may be coupled to the spring coupling part 101*a*.

The linear compressor 10 further includes a second support device 185 coupled to the rear cover 170 to support the other side of the main body of the compressor 10. The second support device 185 may be coupled to the first shell cover 102 to elastically support the main body of the compressor 10. In detail, the second support device 185 includes a second support spring 186. The second support spring 186 may be coupled to the cover support part 102*a*.

Figure 5:
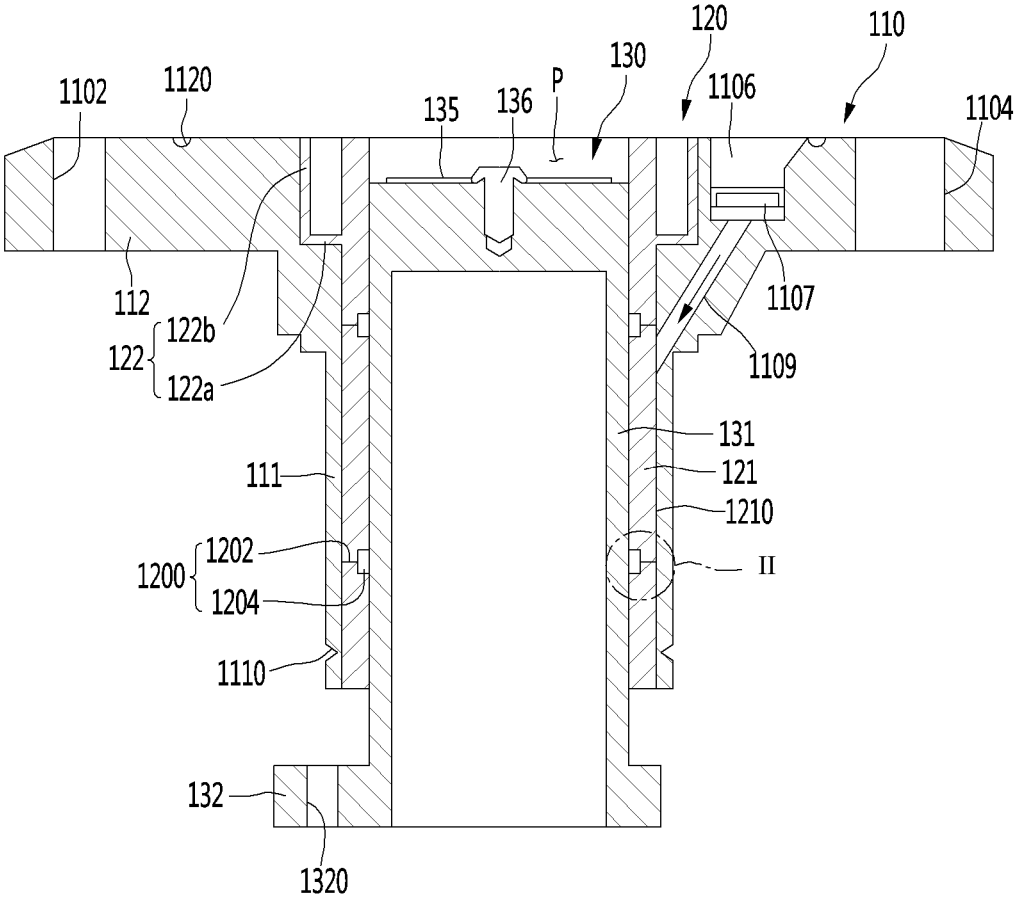
FIG. 5 is a cross-sectional view of a frame, a cylinder, and a piston in FIG. 4 in addition to the flow of a bearing refrigerant.

FIG. 5 is a cross-sectional view of the frame, the cylinder, and the piston in FIG. 4 in addition to the flow of the bearing refrigerant. For convenience of description, the frame 110, the cylinder 120, and the piston 130 will be illustrated in FIG. 5, and also, other components will be omitted.

As illustrated in FIG. 5, the cylinder 120 is disposed inside the frame 110, and the piston 130 is disposed inside the cylinder 120.

The frame 110 includes a frame body 111 extending in the axial direction and a frame flange 112 extending outward from the frame body 111 in the radial direction. Here, the frame body 111 and the frame flange 112 may be integrated with each other.

The frame body 111 has a cylindrical shape of which upper and lower ends in the axial direction are opened. The cylinder 120 is accommodated inside the frame body 111 in the radial direction. The inner stator 148 is coupled to the outside of the frame body 111 in the radial direction, and also, the permanent magnet 146 and the outer stator 141 are disposed inside the frame body 111 in the radial direction.

The frame flange 112 have a circular plate shape having a predetermined thickness in the axial direction. Particularly, the frame flange 112 extends from a front end of the frame body 111 in the radial direction. Thus, the inner stator 148, the permanent magnet 146, and the outer stator 141, which are disposed outside the frame body 111 in the radial direction, may be disposed at a rear side of the frame flange 112 in the axial direction.

Also, a plurality of openings passing in the axial direction are defined in the frame flange 112. Here, the plurality of openings include a discharge coupling hole 1100 (see FIG. 3), a stator coupling hole 1102, and a terminal insertion hole 1104.

A predetermined coupling member (not shown) for coupling the discharge cover 160 to the frame 110 is inserted into the discharge coupling hole 1100. In detail, the coupling member (not shown) may be inserted to a front side of the frame flange 112 by passing through the discharge cover 160.

The cover coupling member 149*a* that is described above is inserted into the stator coupling hole 1102. The cover coupling member 149*a* may couple the stator cover 149 to the frame flange 112 to fix the outer stator 114 disposed between the stator cover 149 and the frame flange 112 in the axial direction.

The above-described terminal part 141*d* of the outer stator 141 may be inserted into the terminal insertion hole 1104. That is, the terminal part 141*d* may be withdrawn or exposed to the outside through the terminal insertion hole 1104 by passing from the rear side to the front side of the frame 110.

Here, each of the discharge coupling hole 1100, the stator coupling hole 1102, and the terminal insertion hole 1104 may be provided in plurality, which are sequentially disposed spaced apart from each other in the circumferential direction. For example, each of the discharge coupling hole 1100, the stator coupling hole 1102, and the terminal insertion hole 1104 may be provided in three, which are sequentially disposed at an angle of about 120 degrees in the circumferential direction.

Also, the terminal insertion holes 1104, the discharge coupling holes 1100, and the stator coupling holes 1102 are sequentially disposed to be spaced apart from each other in the circumferential direction. Also, the openings adjacent to each other may be disposed to be spaced an angle of about 30 degrees from each other in the circumferential direction.

For example, the respective terminal insertion holes 1104 and the respective discharge coupling holes 1100 are disposed spaced an angle of about 30 degrees from each other in the circumferential direction. Also, the respective discharge coupling holes 1100 and the respective stator coupling holes 1102 are disposed to be spaced an angle of about 30 degrees from each other in the circumferential direction. For example, the respective terminal insertion holes 1104 and the respective stator coupling holes 1102 are disposed spaced an angle of about 60 degrees from each other in the circumferential direction.

Also, the terminal insertion holes 1104, the discharge coupling holes 1100, and the stator coupling holes 1102 are arranged based on a center of the circumferential direction.

Also, a gas hole 1106 that is recessed backward from the front surface of the frame flange 112 is defined in the frame flange 112. Here, the refrigerant flowing to the gas hole 1106 may correspond to a portion of the refrigerant flowing from the compression space P to the discharge space 160*a*.

As described above, the refrigerant may correspond to a refrigerant that performs a function of a bearing. Thus, hereinafter, this refrigerant called a bearing refrigerant. That is to say, the bearing refrigerant may correspond to a portion of the refrigerant compressed in the compression space P and also correspond to a portion of the refrigerant flowing through the compressor 10.

Also, a bearing supply passage 1109 extending to pass from the frame flange 112 to the frame body 111 is provided in the frame 110. The bearing supply passage 1109 extends from the gas hole 1106 to an inner circumferential surface of the frame body 111. Thus, the bearing supply passage 1109 may be inclined in the radial direction and the axial direction.

Also, a gas filter 1107 for filtering foreign substances contained in the bearing refrigerant may be mounted on the gas hole 1106. For example, the gas hole 1106 may have a cylindrical shape. Also, the gas filter 1107 may be provided as a circular filter and disposed at a rear end of the gas hole 1106 in the axial direction.

Also, various installation grooves into which a sealing member for increasing coupling force between components is inserted may be provided in the frame 110. Also, an installation groove into a sealing member is inserted may be provided in a peripheral component coupled to the frame 110.

For example, a first installation groove 1120 that is recessed backward is provided in the front surface of the frame flange 112. The sealing member inserted into the first installation groove 1120 may be disposed between the frame 110 and the discharge cover 160 to prevent the refrigerant from leaking and increase the coupling force.

Also, a second installation groove 1110 that is recessed inward is provided in an outer circumferential surface of the frame body 111. The sealing member inserted into the second installation groove 1110 may increase coupling force between the frame 110 and the inner stator 148.

The cylinder 120 includes a cylinder body 121 extending in the axial direction and a cylinder flange 122 disposed outside a front portion of the cylinder body 121. The cylinder body 121 has a cylindrical shape with a central axis in the axial direction and is inserted into the frame body 111. Thus, an outer circumferential surface of the cylinder body 121 may be disposed to face an inner circumferential surface of the frame body 111.

The cylinder flange 122 includes a first flange 122*a* extending outward from a front portion of the cylinder body 121 in the radial direction and a second flange 122*b* extending forward from the first flange 122*a*. When the cylinder 120 is accommodated in the frame 110, the second flange 122*b* may be deformed to be press-fitted.

A bearing inflow passage 1200 through which the bearing refrigerant flows may be provided in the cylinder body 121. The bearing inflow passage 1200 may pass through the cylinder body 121 in the radial direction. That is, the bearing inflow passage 1200 extend from the outer circumferential surface to the inner circumferential surface of the cylinder body 121.

The bearing inflow passage 1200 includes a first bearing inflow passage 1202 extending inward from the outer circumferential surface of the cylinder body 121 and a second bearing inflow passage 1204 extending from the first bearing inflow passage 1202 to the inner circumferential surface of the cylinder body 121. This will be described in detail later.

The piston 130 includes a piston body 131 having an approximately cylindrical shape and a piston flange 132 extending from the piston body 131 in the radial direction. The piston body 131 may reciprocate inside the cylinder 120, and the piston flange 132 may reciprocate outside the cylinder 120.

That is, the piston body 131 corresponds to a portion that is accommodated in the cylinder 120. The above-described suction hole 133 is defined in a front surface of the piston body 131. Also, the suction valve 135 is coupled to the front surface of the piston body 131 by the coupling member 136.

In detail, the suction valve 135 is fixed to a central portion of the front surface of the piston body 131. Also, an outer portion of the suction valve 135 may be bent forward by the reciprocating movement of the piston 130 to open the suction hole 133. Also, the refrigerant may flow to the compression space P through the suction hole 133.

The piston flange 132 may extend outward from the piston body 131 in the radial direction and be disposed at a rear side of the cylinder body 121. Also, a piston coupling hole 1320 into which a coupling member for coupling the magnet frame 138 to the support 137 is inserted may be provided in the piston flange 132. The piston coupling hole 1320 may be provided in plurality, which are spaced the same distance from each other in the circumferential direction.

Referring to the above-described structure, a flow of the bearing refrigerant, which is illustrated as an arrow in FIG. 5, will be described. As described above, the bearing refrigerant is understood as a portion of the refrigerant, which flows to the gas hole 1106, of the refrigerant discharged from the compression space P. Also, the bearing refrigerant may pass through the frame 110 through the bearing supply passage 1109 to flow to the outer circumferential surface of the cylinder 120.

Hereinafter, the bearing refrigerant flowing to the outer circumferential surface of the cylinder 120 will be described in detail.

Figure 6:
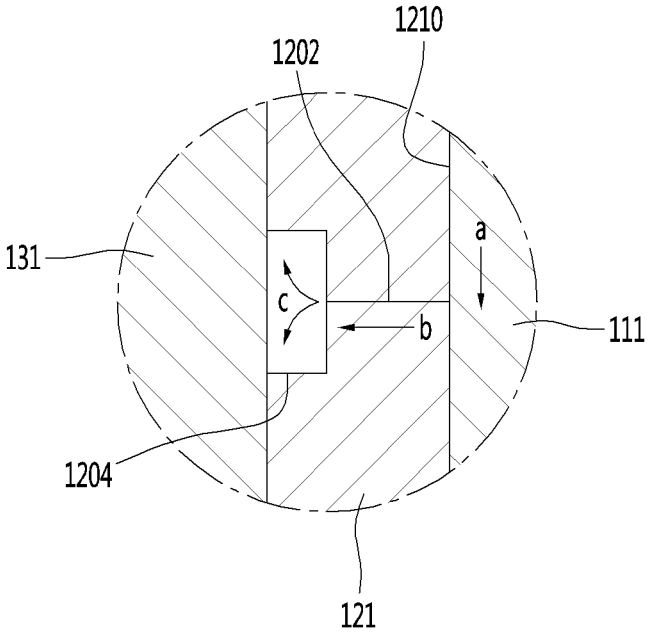
FIG. 6 is a view of a portion B in FIG. 5 in addition to a flow of the bearing refrigerant.

FIG. 6 is a view of a portion B in FIG. 5 in addition to a flow of the bearing refrigerant.

As illustrated in FIG. 6, the inner circumferential surface of the frame body 111 and the outer circumferential surface of the cylinder body 121 may be disposed to contact each other. Here, the contact may mean a state that is spaced a predetermined distance from each other so that a predetermined fluid flows.

That is, although the inner circumferential surface of the frame body 111 and the outer circumferential surface of the cylinder body 121 are closely attached to each other in FIG. 6, a small gap may exist so that a predetermined fluid flows. Thus, the bearing refrigerant may flow.

Here, a portion between the inner circumferential surface of the frame body 111 and the outer circumferential surface of the cylinder body 121 may be called a bearing connection passage 1210. In detail, the bearing connection passage 1210 may be defined as a space spaced between the inner circumferential surface of the frame body 111 and the outer circumferential surface of the cylinder body 121 in the radial direction.

In FIG. 6, a flow of the bearing refrigeration through the bearing connection passage 1210 is illustrated as a reference symbol a. Here, although the bearing refrigerant flows from an upper side to a lower side in the drawing, the flow of the bearing refrigerant through the bearing connection passage 1210 is not limited thereto.

In detail, the bearing refrigerant introduced through the bearing supply passage 1109 may flow through a phenomenon in which the bearing refrigerant is spread to the entire outer circumferential surface of the cylinder 120 through the bearing connection passage 1210. Also, the bearing connection passage 1210 may be modified according to a design error, coupling force, and the like of the frame 110 and the cylinder 120. Thus, a flow of the bearing refrigerant may be differently changed in the bearing connection passage 1210.

The refrigerant flowing to the outer circumferential surface of the cylinder 120 may flow to pass through the cylinder through the bearing inflow passage 1200. In detail, the refrigerant may flow to the inner circumferential surface of the cylinder 120 to the inner circumference surface of the cylinder 120 by passing through the first bearing inflow passage 1202 and the second bearing inflow passage 1204.

In FIG. 6, a flow of the bearing refrigerant through the first bearing inflow passage 1202 is illustrated as a reference symbol b, and a flow of the bearing refrigerant through the second bearing inflow passage 1204 is illustrated as a reference symbol c.

As illustrated in the drawing, the flow b of the bearing refrigerant through the first bearing inflow passage 1202 is generated from the outside to the inside in the radial direction. That is to say, the first bearing inflow passage 1202 corresponds to a passage extending in the radial direction. In detail, the first bearing inflow passage 1202 extends from the outer circumferential surface of the cylinder 120 in the radial direction.

Here, the first bearing inflow passage 1202 may be called an orifice having a very narrow passage or cross-section. That is, the first bearing inflow passage 1202 may be understood as a structure that restricts an amount of refrigerant flowing through the bearing inflow passage 1200.

That is to say, a very small amount of refrigerant may flow through the first bearing inflow passage 1202. This is done because 1) a flow amount of refrigerant is low because the first bearing inflow passage 1202 has a very narrow cross-section and 2) a flow rate of refrigerant is reduced because flow resistance is very large.

As described above, the bearing refrigerant corresponds to a portion of the refrigerant compressed in the compression space P. That is, the whole system in which an amount of refrigerant flows is reduced by an amount of bearing refrigerant. Thus, it is necessary to minimize the amount of bearing refrigerant, and the first bearing inflow passage 1202 may restrict the amount of refrigerant.

The flow c of the bearing refrigerant through the second bearing inflow passage 1204 is generated in the circumferential direction. That is to say, the second bearing inflow passage 1204 corresponds to a passage extending in the circumferential direction. Thus, the flow c of the bearing refrigerant through the second bearing inflow passage 1204 is generated from the front side to the rear side in the drawing.

Also, the second bearing inflow passage 1204 is recessed outward from the inner circumferential surface of the cylinder 120 in the radial direction. Thus, the second bearing inflow passage 1204 of FIG. 6 corresponds to a cross-section of the second bearing inflow passage 1204. That is, an area recessed from the inner circumferential surface of the cylinder 120 corresponds to a cross-section of the second bearing inflow passage 1204.

Here, the second bearing inflow passage 1204 may have a cross-sectional area that is very larger than that of the first beating inflow passage 1202. As described above, this is done because the first bearing inflow passage 1202 has a very narrow cross-sectional area.

The second bearing inflow passage 1204 may accommodate the bearing refrigerant introduced through the first bearing inflow passage 1202. Here, the second bearing inflow passage 1204 may be called a pocket in which the bearing refrigerant is accommodated. Also, the piston 130 may be supported by the bearing refrigerant accommodated in the second bearing inflow passage 1204.

Hereinafter, the bearing inflow passage 1200 will be described in detail.

Figure 7:
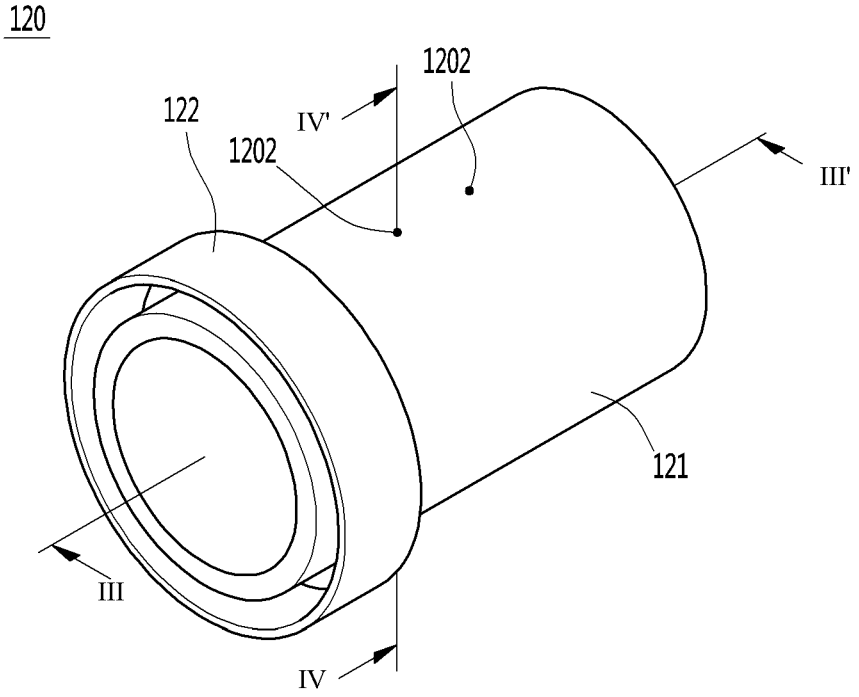
FIG. 7 is a view illustrating the cylinder of the linear compressor according to an embodiment.
Figure 8:
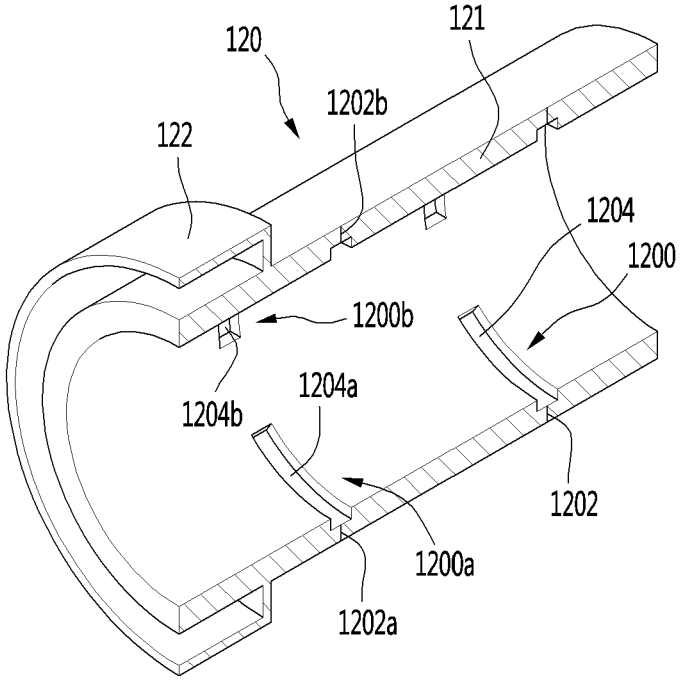
FIG. 8 is a cross-sectional view taken along line C-C' of FIG. 7 (a first embodiment).
Figure 9:
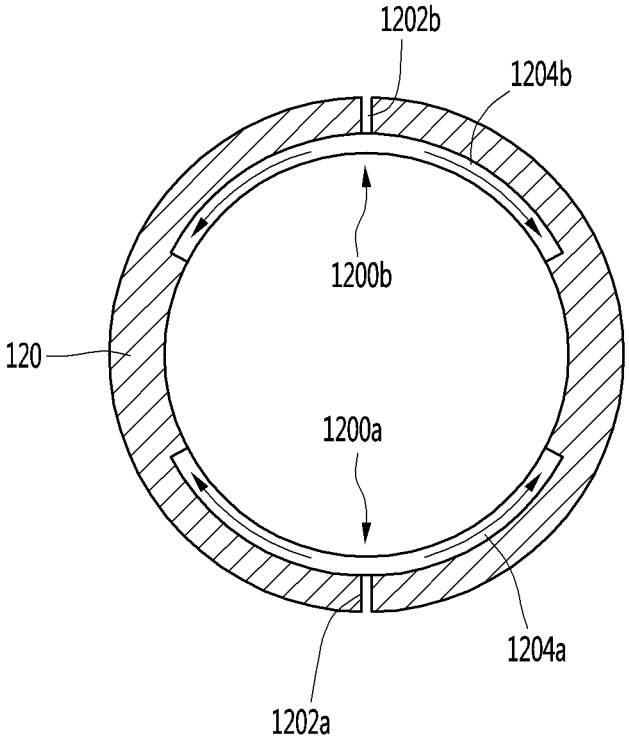
FIG. 9 is a cross-sectional view taken along line D-D' of FIG. 7 in addition to the flow of the refrigerant (the first embodiment).

FIG. 7 is a view illustrating the cylinder of the linear compressor according to an embodiment, FIG. 8 is a cross-sectional view taken along line C-C' of FIG. 7, and FIG. 9 is a cross-sectional view taken along line D-D' of FIG. 7 in addition to the flow of the refrigerant. FIGS. 8 and 9 illustrate a bearing inflow passage according to a first embodiment.

As illustrated in FIGS. 7 to 9, the bearing inflow passage 1200 is provided in plurality in the cylinder 120. In detail, the bearing inflow passage 1200 may be provided in plurality in the axial direction. The number of bearing inflow passage 1200 and a distance spaced between the bearing inflow passages 1200 may be merely illustrative.

FIGS. 7 to 9 illustrate a pair of bearing inflow passages 1200 spaced apart from each other in the axial direction. For convenience of description, the front bearing inflow passage disposed at a front side in the axial diction and the rear bearing inflow passage disposed at a rear side in the axial direction may be divided. Here, the front bearing inflow passage may be disposed behind the cylinder flange 122 in the axial direction.

Also, the bearing inflow passage 1200 may be provided in plurality in the circumferential direction. FIGS. 7 to 9 illustrate a pair of bearing inflow passages 1200 spaced apart from each other in the circumferential direction. Here, the pair of bearing inflow passages 1200 are divided into a first are bearing inflow passage 1200*a* and a second arc bearing inflow passage 1200*b*.

Also, the pair of arc bearing inflow passages 1200*a* and 1200*b*, which are spaced apart from each other in the circumferential direction, are disposed on the same plane in the axial direction and disposed to be opposite to each other in the radial direction.

Also, the front bearing inflow passage and the rear bearing inflow passage include the pair of arc bearing inflow passages 1200*a* and 1200*b*, respectively. Thus, total four bearing inflow passages 1200 may be provided in the cylinder 120.

In summary, at least portions of the bearing inflow passages 1200 may be disposed on the same planes in the axial direction, and at least portions may be disposed spaced apart from each other in the circumferential direction. Also, at least portions of the bearing inflow passages 1200 may be disposed to be opposite to each other in the radial direction. Also, at least portions of the bearing inflow passages 1200 may be disposed spaced apart from each other in the axial direction.

Here, since the front bearing inflow passage and the rear bearing inflow passage have the same shape, one of the front and rear bearing inflow passages will be described. Thus, the plurality of arc bearing inflow passages 1200*a* and 1200*b* disposed on the same plane in the axial direction will be described.

Each of the arc bearing inflow passages 1200*a* and 1200*b* includes the first bearing inflow passage 1202 and the second bearing inflow passage 1204. That is, the pair of first bearing inflow passages 1202 spaced apart from each other in the circumferential direction and the pair of second bearing inflow passages 1204 spaced apart from each other in the circumferential direction may be provided.

Here, the first bearing inflow passage 1202 of the first arc bearing inflow passages 1200*a* is called a first orifice 1202*a*, and the first bearing inflow passage 1202 of the second arc bearing inflow passages 1200*b* is called a second orifice 1202*b*. Also, the second bearing inflow passage 1204 of the second arc bearing inflow passages 1200*a* is called a second pocket 1204*a*, and the second bearing inflow passage 1204 of the second arc bearing inflow passages 1200*b* is called a second pocket 1204*b*.

The first orifice 1202*a* and the second orifice 1202*b* may be disposed in the same line in the radial direction. That is, the pair of orifices 1202*a* and 1202*b* are disposed spaced a minimum distance from each other in the circumferential direction. Here, referring to FIG. 8, since the orifice 1202 has a very narrow passage or cross-sectional area, the orifice 1202 may be illustrated in the cylinder 120 as a line extending in the radial direction.

Also, for convenience of description, in FIGS. 7 and 9, the cross-sectional area of the orifice 1202 is illustrated to be slightly enlarged. In detail, in FIG. 7, the orifice 1202 is illustrated as a hole defined in the outer circumferential surface of the cylinder 120. Also, in FIG. 9, the orifice 1202 is illustrated as a path defining a predetermined passage.

Referring to FIGS. 8 and 9, the pocket 1204 extends to both sides of the circumferential direction by using the orifice 1202 as a center. Here, the pair of pockets 1204*a* and 1204*b* extend from the pair of orifices 1202*a* and 1202*b* so as to be close to each other, respectively.

Also, the pocket 1204 has a rectangular cross-section. That is to say, the pocket 1204 is recessed in a rectangular shape from the inner circumferential surface of the cylinder 120. That is to say, the pocket 1204 extends in a rectangular shape from the inner circumferential surface of the cylinder 120 in the circumferential direction.

Particularly, the pocket 1204 may extend in the form of the same cross-section in the circumferential direction. Thus, the pocket 1204 may have both ends that are recessed in the same rectangular shape.

Here, as the pocket 1204 extends in the circumferential direction, the piston 130 may be effectively supported. That is to say, the pocket 1204 may extend in the circumferential direction to surround the outer circumferential surface of the piston 130, thereby supporting the piston 130.

However, the first pocket 1204*a* and the second pocket 1204*b* are disposed to be spaced apart from each other. If the first pocket 1204*a* and the second pocket 1204*b* contact each other, an inner pressure of each of the first pocket 1204*a* and the second pocket 1204*b* is reduced. That is, a pressure for supporting the piston 130 is reduced.

As a result, the first pocket 1204*a* and the second pocket 1204*b* are disposed to be spaced apart from each other and extend in the circumferential direction. Thus, the inner circumferential surface of the cylinder 120, in which the pocket 1204 is provided, may have an uneven structure in the circumferential direction.

FIG. 9 illustrates the flow c of the bearing refrigerant through the pocket 1204. As illustrated in FIG. 9, the refrigerant introduced into the orifice 1202 may flow along the pocket 1204 in the circumferential direction. That is, the bearing refrigerant may be filled into the pocket 1204 that is recessed from the inner circumferential surface of the cylinder 120.

Hereafter, referring to FIG. 9, force for supporting the piston 130 through the bearing refrigerant accommodated in the pocket 1204 will be described in detail. The piston 130 is movably accommodated in the cylinder 120. Here, the cylinder 120 is fixed to the frame 110, and the piston 130 reciprocates.

Thus, each of the inner circumferential surface of the cylinder 120 and the outer circumferential surface of the piston 130 may be designed to have a predetermined tolerance so that the piston 130 is movable. Also, the piston 130 may be eccentric to one side within the cylinder 120 according to the reciprocation or design of the piston 130.

For example, it is assumed that the piston 130 is eccentric to the first arc bearing inflow passage 1200*a*. Thus, the refrigerant accommodated in the first pocket 1204*a* is subjected to a relatively high pressure, and the refrigerant accommodated in the second pocket 120*b* is subjected to a relatively low pressure.

That is, a difference in pressure between the first pocket 1204*a* and the second pocket 1204*b* occurs. Thus, the piston 130 may be subjected to support force at which the piston 130 is away from the first pocket 1204*a* and close to the second pocket 1204*b*. Thus, a central axis of the piston 130 may be fixed, and friction between the piston 130 and the cylinder 120 may be prevented.

Here, the pocket 1204 may be provided in various numbers and shapes. Hereinafter, a bearing inflow passage according to another embodiment will be described. Also, for convenience of description, only the features different from the foregoing embodiment will be described in other embodiments, and the description of the same portions will be omitted and cited from those of the foregoing embodiment.

Figure 10:
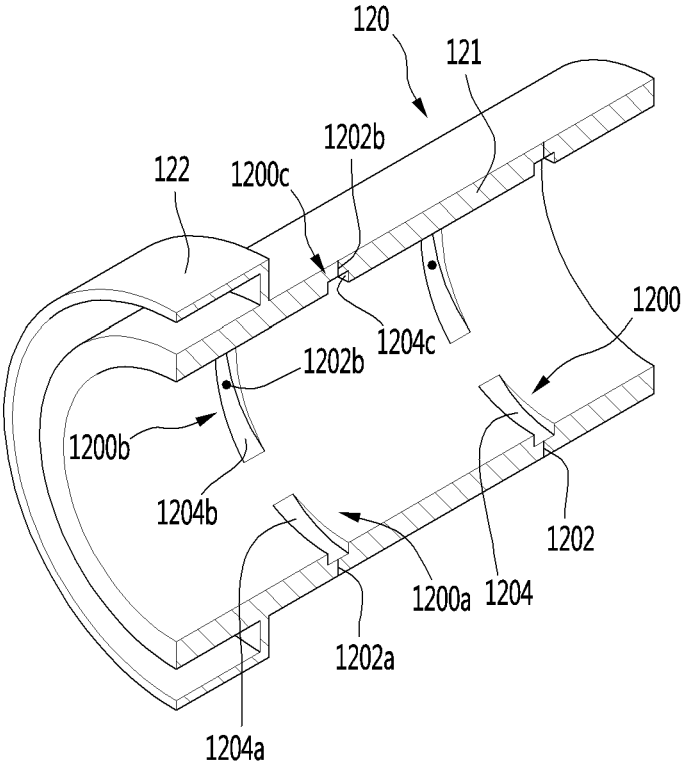
FIG. 10 is a cross-sectional view taken along line C-C' of FIG. 7 (a second embodiment).
Figure 11:
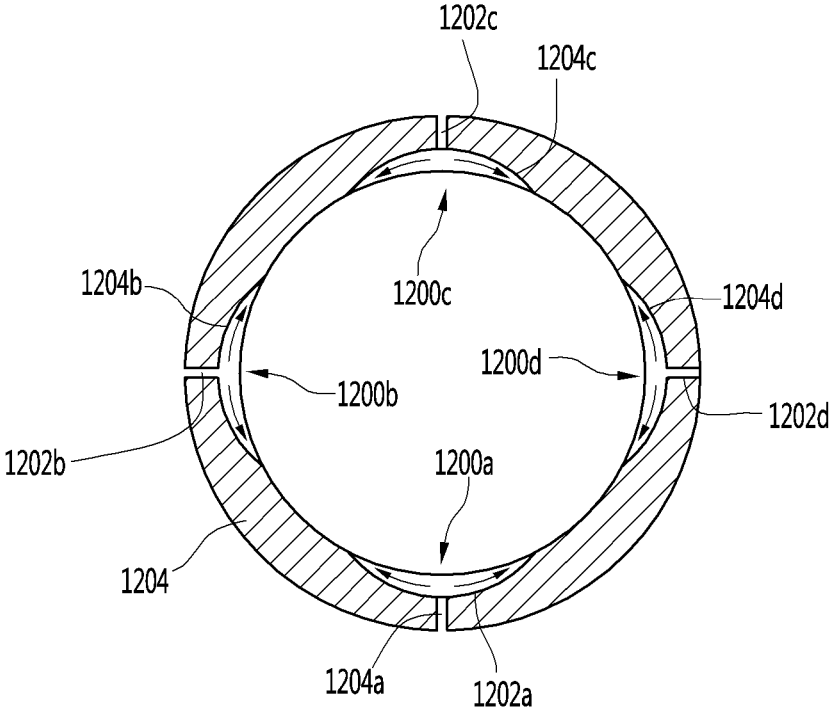
FIG. 11 is a cross-sectional view taken along line D-D' of FIG. 7 in addition to the flow of the refrigerant (the second embodiment).

FIG. 10 is a cross-sectional view taken along line C-C' of FIG. 7, and FIG. 11 is a cross-sectional view taken along line D-D' of FIG. 7 in addition to the flow of the refrigerant. FIGS. 10 and 11 are views of a bearing inflow passage according to a second embodiment.

As illustrated in FIGS. 10 and 11, the bearing inflow passage 1200 is provided in plurality in the cylinder 120. In detail, the bearing inflow passage 1200 may be provided in plurality in the axial direction. The number of bearing inflow passage 1200 and a distance spaced between the bearing inflow passages 1200 may be merely illustrative.

FIGS. 10 and 11 illustrate a pair of bearing inflow passages 1200 spaced apart from each other in the axial direction. For convenience of description, the front bearing inflow passage disposed at a front side in the axial diction and the rear bearing inflow passage disposed at a rear side in the axial direction may be divided. Here, the front bearing inflow passage may be disposed behind the cylinder flange 122 in the axial direction.

Also, the bearing inflow passage 1200 may be provided in plurality in the circumferential direction. FIGS. 10 to 11 illustrate 4 bearing inflow passages 1200 spaced apart from each other in the circumferential direction. Here, the four bearing inflow passages 1200 are divided into a first arc bearing inflow passage 1200*a*, a second arc bearing inflow passage 1200*b*, a third arc bearing inflow passage 1200*c*, and a fourth arc bearing inflow passage 1200*d* when viewed in a counterclockwise direction.

Also, the four arc bearing inflow passages 1200*a*, 1200*b*, 1200*c*, and 1200*d* are disposed on the same planes in the axial direction. Also, the first arc bearing inflow passage

1200*a* and the third arc bearing inflow passage 1200*c* may be disposed to face each other in the radial direction, and the second arc bearing inflow passage 1200*b* and the fourth arc bearing inflow passage 1200*d* may be disposed to face each other in the radial direction.

Also, the front bearing inflow passage and the rear bearing inflow passage include the four arc bearing inflow passages 1200*a*, 1200*b*, 1200*c*, and 1200*d*, respectively. Thus, total eight bearing inflow passages 1200 may be provided in the cylinder 120.

Here, since the front bearing inflow passage and the rear bearing inflow passage have the same shape, one of the front and rear bearing inflow passages will be described. Thus, the plurality of arc bearing inflow passages 1200*a*, 1200*b*, 1200*c*, and 1200*d* disposed on the same plane in the axial direction will be described.

Each of the arc bearing inflow passages 1200*a*, 1200*b*, 1200*c*, and 1200*d* includes the first bearing inflow passage 1202 and the second bearing inflow passage 1204. That is, the four first bearing inflow passages 1202 spaced apart from each other in the circumferential direction and the four second bearing inflow passages 1204 spaced apart from each other in the circumferential direction may be provided.

Here, the first bearing inflow passage 1202 of the first arc bearing inflow passages 1200*a* is called a first orifice 1202*a*, and the first bearing inflow passage 1202 of the second arc bearing inflow passages 1200*b* is called a second orifice 1202*b*. Also, the first bearing inflow passage 1202 of the third arc bearing inflow passages 1200*c* is called a third orifice 1202*c*, and the first bearing inflow passage 1202 of the fourth arc bearing inflow passages 1200*d* is called a fourth orifice 1202*d*.

Also, the second bearing inflow passage 1204 of the second arc bearing inflow passages 1200*a* is called a second pocket 1204*a*, and the second bearing inflow passage 1204 of the second arc bearing inflow passages 1200*b* is called a second pocket 1204*b*. Also, the second bearing inflow passage 1204 of the third arc bearing inflow passages 1200*c* is called a third pocket 1204*c*, and the second bearing inflow passage 1204 of the fourth arc bearing inflow passages 1200*d* is called a fourth pocket 1204*d*.

The orifices 1202*a*, 1202*b*, 1202*c*, and 1202*d* may be disposed to be spaced a maximum distance from each other in the circumferential direction. That is, the orifices 1202*a*, 1202*b*, 1202*c*, and 1202*d* may be disposed to be spaced an angle of about 90 degrees from each other in the circumferential direction. Thus, the first orifice 1202*a* and the third orifice 1202*c* may be disposed in the same line in the radial direction, and the second orifice 1202*b* and the fourth orifice 1202*d* may be disposed in the same line in the radial direction.

Here, referring to a cross-section of FIG. 10, since the orifice 1202 has a very narrow passage or cross-sectional area, the orifice 1202 may be illustrated in the cylinder 120 as a line extending in the radial direction. Also, for convenience of description, the orifice 1202 is illustrated as a hole in FIG. 10 and illustrated as a path defining a predetermined passage in FIG. 11.

Referring to FIGS. 10 and 11, the pocket 1204 extends to both sides of the circumferential direction by using the orifice 1202 as a center. Here, the pockets 1204*a*, 1204*b*, 1204*c*, and 1204*d* extend close to the orifices 1202*a*, 1202*b*, 1202*c*, and 1202*c*, respectively.

Also, the pocket 1204 has a rectangular cross-section. That is to say, the pocket 1204 is recessed in a rectangular shape from the inner circumferential surface of the cylinder 120. Particularly, the pocket 1204 extends from the inner circumferential surface of the cylinder 120 so that the cross-section of the pocket 1204 varies in the circumferential direction.

In detail, the pocket 1204 may extend in the circumferential direction so that the cross-section of the pocket 1204 gradually decreases with respect to the orifice 1202. Thus, as illustrated in FIG. 11, the cross-section of the pocket 1204 in the circumferential direction may have a crescent shape.

Here, as the pocket 1204 extends in the circumferential direction, the piston 130 may be effectively supported. That is to say, the pocket 1204 may extend in the circumferential direction to surround the outer circumferential surface of the piston 130, thereby supporting the piston 130.

The pockets 1204*a*, 1204*b*, 1204*c*, and 1204*d* are disposed to be spaced apart from each other. If the pockets adjacent to each other in the circumferential direction contact each other, an inner pressure of each of the pockets may be reduced. That is, a pressure for supporting the piston 130 is reduced.

As a result, the pockets 1204*a*, 1204*b*, 1204*c*, and 1204*d* are disposed to be spaced apart from each other and extends in the circumferential direction. Thus, the inner circumferential surface of the cylinder 120, in which the pocket 1204 is provided, may have an uneven structure in the circumferential direction.

FIG. 11 illustrates the flow c of the bearing refrigerant through the pocket 1204. As illustrated in FIG. 9, the refrigerant introduced into the orifice 1202 may flow along the pocket 1204 in the circumferential direction. That is, the bearing refrigerant may be filled into the pocket 1204 that is recessed from the inner circumferential surface of the cylinder 120.

Hereafter, referring to FIG. 11, force for supporting the piston 130 through the bearing refrigerant accommodated in the pocket 1204 will be described in detail. The piston 130 is movably accommodated in the cylinder 120. Also, each of the inner circumferential surface of the cylinder 120 and the outer circumferential surface of the piston 130 may be designed to have a predetermined tolerance so that the piston 130 is movable.

The piston 130 may be eccentric to one side within the cylinder 120 according to the reciprocation or design of the piston 130. For example, it is assumed that the piston 130 is eccentric to the first arc bearing inflow passage 1200*a* and the second arc bearing inflow passage 1200*b*.

Thus, the refrigerant accommodated in the first pocket 1204*a* and the second pocket 1204*b* may be subjected to a relatively high pressure, and the refrigerant accommodated in the third pocket 1204*c* and the fourth pocket 1204*d* may be subjected to a relatively low pressure.

That is, a difference in pressure between the first and second pockets 1204*a* and 1204*b* and between the third and fourth pockets 1204*c* and 1204*d* occurs. Thus, the piston 130 may be subjected to support force at which the piston 1204*a* is away from the first and second pockets 1204*a* and 1204*b* and close to the third and fourth pockets 1204*c* and 1204*d*. Thus, a central axis of the piston 130 may be fixed, and friction between the piston 130 and the cylinder 120 may be prevented.

Here, the number of bearing inflow passages illustrated in FIGS. 10 and 11 is greater than that of bearing inflow passages illustrated in FIGS. 8 and 9 in the circumferential direction. This is understood that the number of support members supporting the piston 130 increases in the circumferential direction. Thus, the piston 130 may be more effectively supported.

As described above, the bearing inflow passage according to the ideas of the present disclosure may be provided in various numbers, which are spaced apart from each other in the circumferential direction. Also, the cross-sectional area of the pocket may vary in the circumferential direction and also have various shapes.

Figure 12:
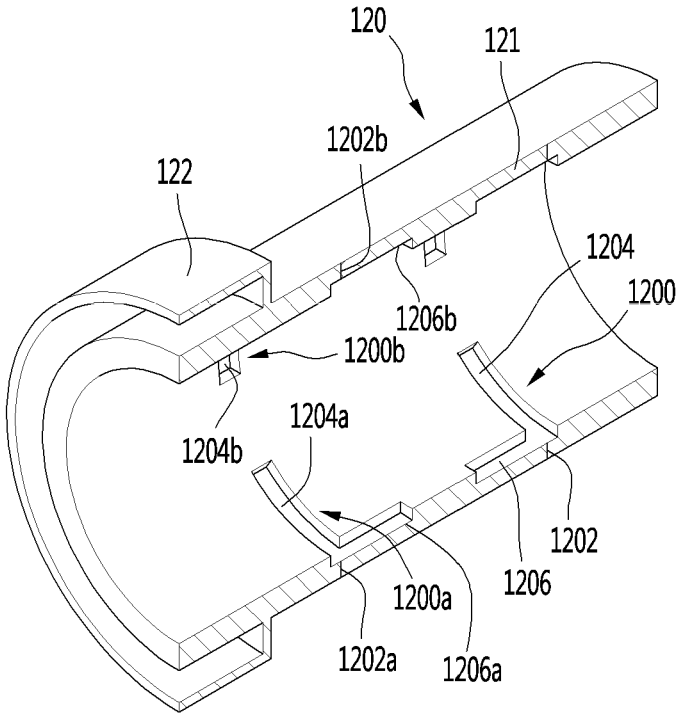
FIG. 12 is a cross-sectional view taken along line C-C' of FIG. 7 (a third embodiment).

FIG. 12 is a cross-sectional view taken along line C-C' of FIG. 7. FIG. 12 is a cross-sectional view of a bearing inflow passage according to a third embodiment. Also, the cross-section taken along line D-D' of FIG. 7 is the same that of the bearing inflow passage according to the first embodiment (see FIG. 9).

As illustrated in FIG. 12, the bearing inflow passage 1200 is provided in plurality in the cylinder 120. In detail, the bearing inflow passage 1200 may be provided in plurality in the axial direction. The number of bearing inflow passage 1200 and a distance spaced between the bearing inflow passages 1200 may be merely illustrative.

FIG. 12 illustrates a pair of bearing inflow passages 1200 spaced apart from each other in the axial direction. For convenience of description, the front bearing inflow passage disposed at a front side in the axial diction and the rear bearing inflow passage disposed at a rear side in the axial direction may be divided. Here, the front bearing inflow passage may be disposed behind the cylinder flange 122 in the axial direction.

Also, the bearing inflow passage 1200 may be provided in plurality in the circumferential direction. FIG. 12 illustrate a pair of bearing inflow passages 1200 spaced apart from each other in the circumferential direction. Here, the pair of bearing inflow passages 1200 are divided into a first arc bearing inflow passage 1200*a* and a second arc bearing inflow passage 1200*b*.

Also, the pair of arc bearing inflow passages 1200*a* and 1200*b*, which are spaced apart from each other in the circumferential direction, are disposed on the same plane in the axial direction and disposed to be opposite to each other in the radial direction.

Also, the front bearing inflow passage and the rear bearing inflow passage include the pair of arc bearing inflow passages 1200*a* and 1200*b*, respectively. Thus, total four bearing inflow passages 1200 may be provided in the cylinder 120.

In summary, at least portions of the bearing inflow passages 1200 may be disposed on the same planes in the axial direction, and at least portions may be disposed spaced apart from each other in the circumferential direction. Also, at least portions of the bearing inflow passages 1200 may be disposed to be opposite to each other in the radial direction. Also, at least portions of the bearing inflow passages 1200 may be disposed spaced apart from each other in the axial direction.

As described above, the bearing inflow passage 1200 includes the first bearing inflow passage 1202 and the second bearing inflow passage 1204. Also, the bearing inflow passage 1200 further include a third bearing inflow passage 1206 extending from the first bearing inflow passage 1202 to the inner circumferential direction of the cylinder body 121.

The third bearing inflow passage 1206 is recessed outward from the inner circumferential surface of the cylinder 120 in the radial direction, like the second bearing inflow passage 1204. Also, the third bearing inflow passage 1206 extends in the axial direction. That is, the third bearing inflow passage 1206 is provided in the inner circumferential surface of the cylinder 120 in a direction perpendicular to the second bearing inflow passage 1204.

Here, the third bearing inflow passage 1206 may have the same cross-section as the second bearing inflow passage 1204. However, this is merely illustrative. Thus, the third bearing inflow passage 1206 and the second bearing inflow passage 1204 may be recessed in the cylinder 120 so as to have sizes and shapes different from each other.

Also, the third bearing inflow passage 1206 may accommodate the bearing refrigerant introduced through the first bearing inflow passage 1202. Thus, the third bearing inflow passage 1206 together with the second bearing inflow passage 1204 may be called a pocket in which the bearing refrigerant is accommodated. Also, the piston 130 may be supported by the bearing refrigerant accommodated in the second and third bearing inflow passages 1204 and 1206.

Hereinafter, the front bearing inflow passage provided as the pair of arc bearing inflow passages 1200*a* and 1200*b* will be described.

Each of the arc bearing inflow passages 1200*a* and 1200*b* includes the first bearing inflow passage 1202, the second bearing inflow passage 1204, and the third bearing inflow passage 1204. That is, the pair of first bearing inflow passages 1202 spaced apart from each other in the circumferential direction, the pair of second bearing inflow passages 1204 spaced apart from each other in the circumferential direction, and the pair of third bearing inflow passages 1206 spaced apart from each other in the circumferential direction may be provided.

Here, the first bearing inflow passage 1202 of the first arc bearing inflow passages 1200*a* is called a first orifice 1202*a*, and the first bearing inflow passage 1202 of the second arc bearing inflow passages 1200*b* is called a second orifice 1202*b*.

Also, the second bearing inflow passage 1204 and the third bearing inflow passage 1206 of the first arc bearing inflow passage 1200*a* are called first pockets 1204*a* and 1206*a*. Also, for classification, the second bearing inflow passage 1204 may be called a first cover pocket 1204*a*, and the third bearing inflow passage 1206 may be called a first linear pocket 1206*a*.

Also, the second bearing inflow passage 1204 and the third bearing inflow passage 1206 of the second arc bearing inflow passage 1200*b* are called second pockets 1204*b* and 1206*b*. Also, for classification, the second bearing inflow passage 1204 may be called a second cover pocket 1204*a*, and the third bearing inflow passage 1206 may be called a second linear pocket 1206*a*.

The first orifice 1202*a* and the second orifice 1202*b* may be disposed in the same line in the radial direction. That is, the pair of orifices 1202*a* and 1202*b* are disposed spaced a minimum distance from each other in the circumferential direction. Referring to FIG. 12, since the orifice 1202 has a very narrow passage or cross-sectional area, the orifice 1202 may be illustrated in the cylinder 120 as a line extending in the radial direction.

Referring to FIG. 12, the pockets 1204 and 1206 extend from the orifice 1202.

Also, each of the pockets 1204 and 1206 may have a rectangular cross-section. That is to say, each of the pockets 1204 and 12006 is recessed in a rectangular shape from the inner circumferential surface of the cylinder 120. That is to say, each of the pockets 1204 and 1206 extends in a rectangular shape from the inner circumferential surface of the cylinder 120.

Particularly, the pockets 1204, 1204 may extend in the form of the same cross-section. Thus, each of the pockets 1204 and 1206 may have an end recessed in the same rectangular shape. However, this is merely illustrative, and thus, the cross-section may extend to vary as described in the second embodiment.

The cover pocket 1204 extends from the orifice 1202 in the circumferential direction. Particularly, the cover pockets 1204*a* and 1204*b* extend from the pair of orifices 1202*a* and 1202*b* so as to be close to each other, respectively.

Here, as the cover pocket 1204 extends in the circumferential direction, the piston 130 may be effectively supported. That is to say, the cover pocket 1204 may extend in the circumferential direction to surround the outer circumferential surface of the piston 130, thereby supporting the piston 130.

However, the first cover pocket 1204*a* and the second cover pocket 1204*b* are disposed to be spaced apart from each other. If the first cover pocket 1204*a* and the second cover pocket 1204*b* contact each other, an inner pressure of each of the first cover pocket 1204*a* and the second curve pocket 1204*b* is reduced. That is, a pressure for supporting the piston 130 is reduced.

As a result, the first curve pocket 1204*a* and the second curve pocket 1204*b* are disposed to be spaced apart from each other and extend in the circumferential direction. Thus, the inner circumferential surface of the cylinder 120, in which the curve pocket 1204 is provided, may have an uneven structure in the circumferential direction.

The linear pocket 1206 extends from the orifice 1202 in the axial direction. Particularly, the linear pockets 1206*a* and 1206*b* extend in parallel to each other toward one side in the axial direction. As illustrated in FIG. 12, each of the linear pockets 1206*a* and 1206*b* extends in the axial direction.

Here, the linear pocket of the rear bearing inflow passage extends in the axial direction. Thus, it is understood that the linear pockets 1206 extend to be close to each other in the axial direction. However, the linear pockets are disposed to be spaced apart from each other due to the same reason as the curve pockets 1204.

As a result, the linear pocket of the rear bearing inflow passage and the linear pocket of the front bearing inflow passage may extend to be close to each other in the axial direction and be spaced apart from each other in the axial direction. Thus, the inner circumferential surface of the cylinder 120, in which the linear pocket 1206 is provided, may have an uneven structure in the axial direction. Also, the first linear pocket 1206*a* and the second linear pocket 1206*b* extend in parallel to the circumferential direction.

The rear bearing inflow passage is the same the front bearing inflow passage except for the extension direction of the linear pocket. Thus, the description with respect to the rear bearing inflow passage will be omitted to cite the description with respect to the front bearing inflow passage.

Due to the above-described configuration, the pockets 1204 and 1206 may have a 'I' shape. Thus, the bearing refrigerant introduced into the orifice 1202 may flow along the pockets 1204 and 206 in the circumferential direction and the axial direction. That is, the bearing refrigerant may be filled into the pockets 1204 and 1206 that are recessed from the inner circumferential surface of the cylinder 120.

Thus, the pockets 1204 and 1206 may support the piston 130 in the circumferential direction and the axial direction. When comparing the pocket of FIGS. 8 and 9, the piston 130 may be more stably supported.

As described above, the bearing inflow passage according to the ideas of the present disclosure may be formed in various shapes by being recessed from the inner circumferential surface of the cylinder. Also, the pocket may have various shapes to extend in the circumferential direction and the axial direction.

Figure 13:
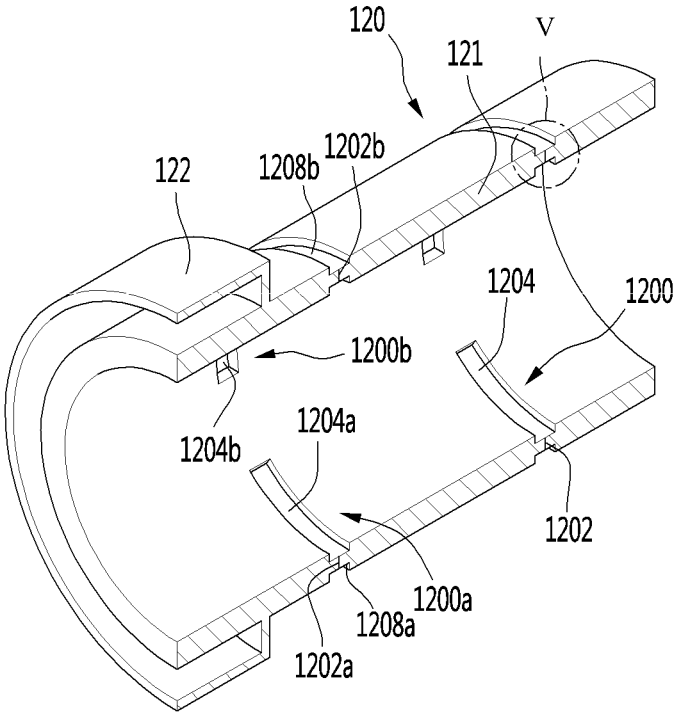
FIG. 13 is a cross-sectional view taken along line C-C' of FIG. 7 (a fourth embodiment).
Figure 14:
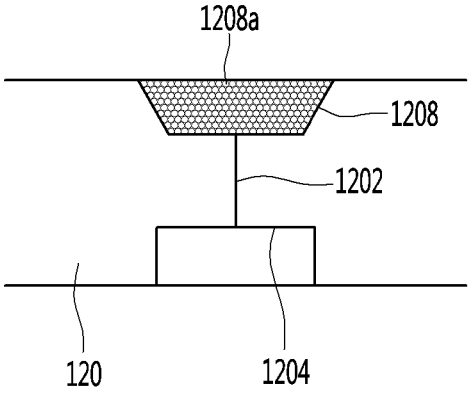
FIG. 14 is a view of a portion E of FIG. 13 in addition to a bearing filter.

FIG. 13 is a cross-sectional view taken along line C-C' of FIG. 7, and FIG. 14 is a view of a portion E of FIG. 13 in addition to a bearing filter. FIGS. 13 and 14 illustrate a bearing inflow passage according to a fourth embodiment. Here, although a cylinder of FIG. 13 is different from the cylinder of FIG. 7, for convenience of description, the cylinder of FIG. 13 will be described with reference to the cross-section taken along line C-C' of FIG. 7.

As illustrated in FIG. 13, the bearing inflow passage 1200 is provided in plurality in the cylinder 120. In detail, the bearing inflow passage 1200 may be provided in plurality in the axial direction. The number of bearing inflow passage 1200 and a distance spaced between the bearing inflow passages 1200 may be merely illustrative.

FIG. 13 illustrates a pair of bearing inflow passages 1200 spaced apart from each other in the axial direction. For convenience of description, the front bearing inflow passage disposed at a front side in the axial diction and the rear bearing inflow passage disposed at a rear side in the axial direction may be divided. Here, the front bearing inflow passage may be disposed behind the cylinder flange 122 in the axial direction.

Also, the bearing inflow passage 1200 may be provided in plurality in the circumferential direction. FIG. 13 illustrate a pair of bearing inflow passages 1200 spaced apart from each other in the circumferential direction. Here, the pair of bearing inflow passages 1200 are divided into a first arc bearing inflow passage 1200*a* and a second arc bearing inflow passage 1200*b*.

Also, the pair of arc bearing inflow passages 1200*a* and 1200*b*, which are spaced apart from each other in the circumferential direction, are disposed on the same plane in the axial direction and disposed to be opposite to each other in the radial direction.

Also, the front bearing inflow passage and the rear bearing inflow passage include the pair of arc bearing inflow passages 1200*a* and 1200*b*, respectively. Thus, total four bearing inflow passages 1200 may be provided in the cylinder 120.

In summary, at least portions of the bearing inflow passages 1200 may be disposed on the same planes in the axial direction, and at least portions may be disposed spaced apart from each other in the circumferential direction. Also, at least portions of the bearing inflow passages 1200 may be disposed to be opposite to each other in the radial direction. Also, at least portions of the bearing inflow passages 1200 may be disposed spaced apart from each other in the axial direction.

As described above, the bearing inflow passage 1200 includes the first bearing inflow passage 1202 and the second bearing inflow passage 1204. Also, the bearing inflow passage 1200 further includes a filter installation groove 1208 that is recessed from the outer circumferential surface of the cylinder 120.

The filter installation groove 1208 may be recessed inward from the outer circumferential surface of the cylinder 120 in the radial direction to be opposite to the second bearing inflow passage 1204. Also, the filter installation groove 1208 extends in the radial direction. That is, the filter installation groove 1208, the first bearing inflow passage 1202, and the second bearing inflow passage 1204 are sequentially provided from the outside to the inside of the cylinder 120 in the radial direction.

Here, the filter installation groove 1208 may be understood as a portion of the outer circumferential surface of the cylinder 120. Thus, it is defined that the first bearing inflow passage 1202 extends inward from the outer circumferential surface of the cylinder body 121.

Referring to FIG. 14, a bearing filter 1208*a* is installed in the filter installation groove 1208. For example, the bearing filter 1208*a* may correspond to a thread filter provided as fiber and the like. Thus, the bearing filter 1208*a* may be disposed to be wound around the outer circumferential surface of the cylinder 120 along the filter installation groove 1208 in the circumferential direction. For convenience in the drawings, the bearing filter 1208*a* is not illustrated in FIG. 13.

The bearing filter 1208*a* performs a function of filtering foreign substances contained in the refrigerant flowing to the bearing inflow passage 1200. Thus, the baring refrigerant is primarily filtered by a gas filter 1107 installed in the gas hole 1106 and then secondarily filtered by the bearing filter 1208*a* so as to be supplied to the piston 130.

Here, since the front bearing inflow passage and the rear bearing inflow passage have the same shape, one of the front and rear bearing inflow passages will be described. Thus, the plurality of arc bearing inflow passages 1200*a* and 1200*b* disposed on the same plane in the axial direction will be described.

Here, the filter installation groove 1208 extends in the circumferential direction and has a ring shape. That is, the filter installation groove 1208 may connect a plurality of arc bearing inflow passages 1200*a* and 1200*b*, which are disposed in the same line in the axial direction, to each other. Thus, the filter installation groove 1208 may be understood as a portion of the outer circumferential surface of the cylinder 120.

The bearing inflow passage may have the same structure as the bearing inflow passage of FIGS. 8 and 9 according to the first embodiment except for the shape of the filter installation groove 1208. Thus, the description with respect to the bearing inflow passage according to this embodiment will be cited and omitted.

As described above, the bearing inflow passage according to the ideas of the present disclosure may be provided in various shapes in the cylinder.

The linear compressor including the above-described constituents according to the embodiment may have the following effects.

Since the piston is supported by using the relatively small amount of gas refrigerant, the consumed flow rate of the refrigerant required for the gas bearing may be reduced. Thus, the flow rate of the refrigerant in the whole system may increase to improve the compression efficiency.

Also, the sufficient amount of refrigerant for supporting the piston may be accommodated through the bearing inflow passage formed to be recessed from the inner circumferential surface of the cylinder.

Particularly, the piston may be effectively supported through the bearing inflow passage formed to extend in the inner circumferential surface of the cylinder in the circumferential direction.

In addition, since the plurality of bearing inflow passages provided in the same plane in the axial direction are spaced apart from each other in the circumferential direction, the relatively high pressure of the refrigerant accommodated in the bearing inflow passages may be maintained. Thus, the supporting force for supporting the piston may increase.

Also, the bearing inflow passage may have various shapes according to the design thereof. Particularly, the bearing inflow passage may have variable cross-section to provide the larger supporting force than that to the piston.

Also, the bearing inflow passage may extend in the axial direction as well as the circumferential direction to more stably support the piston.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor comprising:

a cylinder that extends in an axial direction;

a piston received in the cylinder and configured to reciprocate relative to the cylinder along the axial direction; and a bearing inflow passage that penetrates the cylinder and that is configured to supply refrigerant to the piston, the bearing inflow passage comprising a front bearing inflow passage and a rear bearing inflow passage that are spaced apart from each other in the axial direction, wherein each of the front bearing inflow passage and the rear bearing inflow passage comprises a plurality of arc bearing inflow passages that are spaced apart from each other in a circumferential direction of the cylinder, wherein an arc bearing inflow passage among the plurality of arc bearing inflow passages extends from a portion of an inner circumferential surface of the cylinder along the circumferential direction in both sides with respect to a center of the arc bearing inflow passage, and wherein a cross-sectional area of the arc bearing inflow passage decreases along the circumferential direction as the arc bearing inflow passage extends away from the center of the arc bearing inflow passage.

2. The linear compressor according to claim 1, wherein each of the front bearing inflow passage and the rear bearing inflow passage comprises:

a first bearing inflow passage that extends radially inward from an outer circumferential surface of the cylinder; and a second bearing inflow passage that extends radially inward from the first bearing inflow passage to the inner circumferential surface of the cylinder, and wherein the second bearing inflow passage includes the plurality of arc bearing inflow passages.

3. The linear compressor according to claim 2, wherein a cross-sectional area of the first bearing inflow passage is less than a cross-sectional area of the second bearing inflow passage.

4. The linear compressor according to claim 2, wherein the second bearing inflow passage is recessed radially outward from the inner circumferential surface of the cylinder.

5. The linear compressor according to claim 2, wherein the second bearing inflow passage extends along at least a portion of the inner circumferential surface of the cylinder.

6. The linear compressor according to claim 2, wherein each of the front bearing inflow passage and the rear bearing inflow passage further comprises:

a third bearing inflow passage that extends from the second bearing inflow passage in the axial direction along the inner circumferential surface of the cylinder.

7. The linear compressor according to claim 6, wherein the second bearing inflow passage and the third bearing inflow passage are recessed radially outward from the inner circumferential surface of the cylinder.

8. The linear compressor according to claim 6, wherein the second bearing inflow passage and the third bearing inflow passage are connected to each other at an inner end of the first bearing inflow passage.

9. The linear compressor according to claim 1, wherein each of the front bearing inflow passage and the rear bearing inflow passage comprises a pocket that is recessed radially outward from the inner circumferential surface of the cylinder.

10. The linear compressor according to claim 9, wherein the pocket comprises:

a curve pocket that extends in the circumferential direction, the curve pocket including the plurality of arc bearing inflow passages; and a linear pocket that extends in the axial direction.

11. The linear compressor according to claim 10, wherein each of the front bearing inflow passage and the rear bearing inflow passage further comprises an orifice that extends radially outward from the pocket to an outer circumferential surface of the cylinder.

12. The linear compressor according to claim 11, wherein the curve pocket extends from the orifice in a first direction along the circumferential direction and in a second direction opposite to the first direction.

13. The linear compressor according to claim 12, wherein a recess depth of the curve pocket with respect to the inner circumferential surface of the cylinder decreases as the curve pocket extends from the orifice in both of the first direction and the second direction.

14. The linear compressor according to claim 12, wherein the curve pocket maintains a recess depth with respect to the inner circumferential surface of the cylinder as the curve pocket extends from the orifice in both of the first direction and the second direction.

15. The linear compressor according to claim 2, wherein the bearing inflow passage further comprises a filter installation groove that is recessed radially inward from the outer circumferential surface of the cylinder and that extends in the circumferential direction of the cylinder.

16. The linear compressor according to claim 15, wherein the first bearing inflow passage has an outer end connected to the filter installation groove and an inner end connected to the second bearing inflow passage.

17. The linear compressor according to claim 15, further comprising a bearing filter that is accommodated in the filter installation groove and that is configured to filter foreign substances from refrigerant and supply filtered refrigerant to the first bearing inflow passage.

18. The linear compressor according to claim 1, wherein the plurality of arc bearing inflow passages comprise:

a plurality of front arc bearing passages that are defined at a first plane orthogonal to the axial direction, that are recessed radially outward from the inner circumferential surface of the cylinder, and that are spaced apart from each other in the circumferential direction of the cylinder; and a plurality of rear arc bearing passages that are defined at a second plane orthogonal to the axial direction, that are recessed radially outward from the inner circumferential surface of the cylinder, and that are spaced apart from each other in the circumferential direction of the cylinder.

19. The linear compressor according to claim 18, wherein the front bearing inflow passage comprises a first linear pocket that is recessed from the inner circumferential surface of the cylinder and that extends in the axial direction from each of the plurality of front arc bearing passages toward the rear bearing inflow passage; and wherein the rear bearing inflow passage comprises a second linear pocket that is recessed from the inner circumferential surface of the cylinder and that extends from each of the plurality of rear arc bearing passages toward the first linear pocket.

20. A linear compressor comprising:

a cylinder that extends in an axial direction;

a piston received in the cylinder and configured to reciprocate relative to the cylinder along the axial direction; and a bearing inflow passage that penetrates the cylinder and that is configured to supply refrigerant to the piston, the bearing inflow passage comprising a front bearing inflow passage and a rear bearing inflow passage that are spaced apart from each other in the axial direction, wherein each of the front bearing inflow passage and the rear bearing inflow passage comprises a plurality of arc bearing inflow passages that are spaced apart from each other in a circumferential direction of the cylinder, and wherein a circumferential length of each of the plurality of arc bearing inflow passages is greater than a width of each of the plurality of arc bearing inflow passages in the axial direction.

* * * * *